US006030069A

United States Patent [19]

Wakahara et al.

[11] Patent Number: 6,030,069

[45] Date of Patent: Feb. 29, 2000

[54] IMAGE FORMING APPARATUS, USING SUCTION TO KEEP DISTANCE BETWEEN RECORDING MEDIUM AND CONTROL ELECTRODE UNIFORM WHILE FORMING IMAGE

[75] Inventors: Shirou Wakahara, Osaka; Hironori Ogasawara, Nara, both of Japan

[73] Assignee: Sharp Kabushiki Kaisha, Osaka, Japan

[21] Appl. No.: 08/978,265

[22] Filed: Nov. 25, 1997

[30] Foreign Application Priority Data

Dec. 25, 1996 [JP] Japan ..... 8-345764
Jan. 24, 1997 [JP] Japan ..... 9-011593

[51] Int. Cl.[7] ..... B41J 2/04

[52] U.S. Cl. ..... 347/55

[58] Field of Search ..... 347/55, 154, 103, 347/123, 111, 159, 127, 128, 17, 141, 120, 151; 399/13, 16, 110

[56] References Cited

FOREIGN PATENT DOCUMENTS 134581 5/1993 Japan .

07290752 11/1995 Japan .

*Primary Examiner*—John Barlow
*Assistant Examiner*—Raquel Yvette Gordon
*Attorney, Agent, or Firm*—Dike, Bronstein, Roberts & Cushman, LLP; David G. Conlin; William J. Daley, Jr.

[57] ABSTRACT

This image forming apparatus has an image forming unit which is composed of a toner supplying section and a printing section. The printing section includes: an opposing electrode which has a flat part arranged in parallel with the peripheral surface of a toner support; a high-voltage power source for applying a high voltage to the opposing electrode; a control electrode provided between the toner support and opposing electrode; and a cleaning brush. A paper suction portion includes fans as decompressing means and a chamber with a multiple number of suction ports disposed therein, through which air is sucked so that the sheet will not be in contact with the control electrode. Further, a multiple number of grooves are formed in parallel with the sheet conveying direction on the downstream side of the sheet conveying means with respect the sheet conveying direction. These grooves reduce the contact area between the sheet and the support surface and hence reduce the frictional resistance, thus achieving a smooth paper conveying operation.

44 Claims, 16 Drawing Sheets

IMAGE FORMING APPARATUS, USING SUCTION TO KEEP DISTANCE BETWEEN RECORDING MEDIUM AND CONTROL ELECTRODE UNIFORM WHILE FORMING IMAGE

BACKGROUND OF THE INVENTION (1) Field of the Invention

The present invention relates to an image forming apparatus which is applied to the printer portion of digital copiers and facsimile machines, digital printers, plotters and the like, and in particular relates to an image forming apparatus which creates images on the recording medium by making the developer jump thereto.

(2) Description of the Prior Art

Recently, as an image forming apparatus which reproduces an image signal into a visual image output on a recording medium such as paper etc., an image forming apparatus has been proposed in Japanese Patent Application Laid-Open Hei 5 No. 134,581. The image forming apparatus in this disclosure directly forms toner images on the recording medium by generating an electric field for toner as a developer so as to make the toner jump by electric force whilst a control electrode which has a plurality of passage holes and is arranged in the toner transfer path has varying potentials applied thereto.

The above conventional apparatus includes a developing sleeve, an opposing electrode and a control electrode having openings therebetween. In this conventional art, the voltage to be applied to an opening of the control electrode is switched between a first level of potential which allows toner to pass through the opening and a second level of potential which will not allow toner to pass therethrough so as to control toner transfer thus making it possible to directly form a toner image on the surface of paper.

In the above technology, use is made of the opposing electrode which is made up of a mesh-like roller and a decompressing means disposed inside the roller. In this arrangement, the recording medium is adapted to be conveyed by the rotation of the roller whilst being attracted to the roller by making use of suction force generated by air suction through mesh holes.

In image forming apparatus of the type which directly forms images by making toner jump as typically represented by the above conventional technology, the image is formed by controlling the potential of the control electrode. In the above image forming apparatus, it is preferable that the distance between the control electrode and the opposing electrode is kept uniform and constant. Further, keeping the position of the recording medium or the distance between the control electrode and the recording medium constant will provide excellent conditions for image forming.

However, the distance between the control electrode and the opposing electrode is so short that if plain paper or the like is used as the recording medium, the relative position of the recording medium to the control electrode or the opposing electrode will vary due to wrinkles, curls or elasticity of the recording medium itself and due to electric force exerting on the recording medium if it has charge. If the position of the recording medium changes, the size and shape of dots to be printed thereon varies, possibly causing failure to reproduce a desired image. Further, when the shape and size of dots to be formed vary, the reproduction performance of halftones lowers and make it impossible to create appropriate halftones, giving rise to difficulty in forming a satisfactory image.

If the position of the recording medium changes greatly, it may come in contact with the control electrode. In such a case, the toner which has already transferred to the recording medium is rubbed against the control electrode causing destruction of the image, and in addition, the toner adhering to the control electrode sticks to the recording medium causing background fogginess, or black lines or black smudges especially when the control electrode has been badly stained with toner.

Further, if the recording electrode and the control electrode come in contact with each other, the charge on the recording medium induces electricity on the control electrode surface, so that the charge on the control electrode surface will have potentials relative to the control electrode. As a result, the apparent potential of the control electrode relative to the toner supported on the toner support varies, deviating from the desired potential which has been applied to the control electrode. Accordingly, when the voltage for allowing toner to pass through the passage hole is applied, only an insufficient amount of toner may jump or the jumping itself might become difficult, causing image defect or printing failure, and hence resulting in difficulty in image forming. Even when the image is formed, the resultant image becomes blurred, lacking contrast, and faces difficulty in reproducing halftones because of insufficiency of toner transfer.

Further, when the apparatus is mounted under a high temperature, high humidity environment, the recording medium used absorbs moisture. This reduces its resistivity, and hence the control electrode and the opposing electrode start to conduct through the recording medium, so that the high voltage to the opposing electrode might leak to the control electrode, causing destruction of the devices such as the control electrode and control circuit and further destroying the other appliances connected to this apparatus. In the worst case, the user might be struck by electricity.

In the image forming apparatus disclosed in Japanese Patent Application Laid-Open Hei 5 No. 134,581, when a narrow-width recording medium such as postcards is used, the image forming region will have areas in which no recording medium exists during the printing operation. Since the recording medium must be conveyed by the rotation of the opposing electrode whilst being attracted to the opposing electrode, the recording medium needs to be attracted by a strong force. Therefore, air flow of more than a certain minimum should be formed around the region facing the control electrode. In this arrangement, in the ends of the image forming region where no recording medium exists as stated above, toner exists around the openings of the control electrode facing the aforementioned area while the toner on the developing sleeve is exposed through the opening. Therefore, if the air flow is directly formed with respect to the toner, not only the toner layer is stirred but the toner adhering to the openings and the toner residing on the developing sleeve in the areas facing the openings starts to jump by being sucked in by the air flow, and might transfer toward the opposing electrode thus possibly polluting it. Further, the toner might jump to the nearby recording medium, causing background fogginess and image degradation. This also causes unnecessary toner consumption.

In a conventional color image forming apparatus using a multiple number of developing vessels, there are cases where the developing operation and the cleaning operation are implemented simultaneously. For example, consider a case where development is effected using one of the color developing vessels whilst no recording medium exists on the opposing electrode surfaces facing the other colors of developing vessels. In this case, while the control electrode facing the opposing electrode being unused is being cleaned, the color toner could be scattered by the cleaning operation, for example, brushing. As a result, the scattered toner might transfer to the recording medium residing on the opposing electrode surface engaged in the printing, causing partial color fogginess as well as inducing color mixing.

In order to avoid the aforementioned problems, there is a configuration in which the opposing electrode is provided as a roller, and the recording paper is made to be attracted to this roller-shaped opposing electrode to thereby assure a stable, fixed position of the recording paper. That is, this opposing electrode is made up of a roller having mesh-like holes and a decompressing means for sucking the recording paper to the roller. This decompressing means suctions air through the mesh-like holes so that the recording medium will be attracted to the roller (opposing electrode). In this arrangement, the recording paper is conveyed by the rotation of the roller whilst being sucked.

This configuration, i.e., the roller-shaped opposing electrode is advantageous in conveying the recording medium, but the surface of the recording paper is set so as to be curved so that the distance between the control electrode and the recording paper will not be kept uniform. Therefore, the shape and density of dots formed at the central portion and at the edges become different, in particular, the dots at the edges lowers in density and becomes smaller in diameter, giving rise to difficulties in forming appropriate dots. This not only lowers the contrast and hence causes blurs in the image, but also degrades the reproduction performance of halftones. Furthermore, in the case of a color image forming apparatus, it becomes difficult to reproduce faithful colors.

In this case, this problem can be overcome by varying the voltage being applied to the control electrode so as to compensate for the distance between the control electrode and the recording paper. However, this method uses plural levels of voltages needing more power sources, and it is also necessary to enhance the voltage the driver to be used for switching the voltages can withstand, thus resulting in increased cost.

In order to avoid the above problems originating from the provision of a roller-shaped opposing electrode, there has been an attempt to use a static attraction conveying means in which a belt-shaped opposing electrode is provided while the recording electrode is electrified whereby the recording medium is adapted to be attracted electro-statistically to the belt for conveyance. This method, however, uses a belt and belt driving means, a charging means for recording medium, a charger power source and the like, needing more parts, causing sharp increase in cost. Further, it is impossible to attract the recording medium in some cases due to change in surrounding conditions and/or depending upon the material of the recording medium. In particular, the surface potential of the recording medium is liable to change depending upon its thickness and resistance, so this method involves potentially fatal problems such that the attraction itself becomes difficult.

As a method for avoiding the above various problems, an air suction conveying method has been proposed in which the recording medium is conveyed in a sliding manner whilst being suction applied onto an opposing electrode having a flat surface. In this method, however, since the recording paper is slid whilst being air-sucked, there is a problem that the recording paper vibrates due to frictional force. As the recording medium vibrates, it will separate from the suction port for air suction, markedly reducing the suction force exerted on the recording medium. Consequently, the recording medium will lift up with respect to the opposing electrode, varying the position of the recording medium, thereby causing similar image degradation to that stated above.

SUMMARY OF THE INVENTION

The present invention has been devised in view of the above problems and it is therefore an object of the present invention to provide an image forming apparatus in which the quality of formed images can be improved by keeping uniform the distance between the recording medium and the control electrode and preventing unwanted developer transfer and dispersion of the developer. It is another object of the invention to provide an image forming apparatus in which the recording paper can be conveyed in a stable manner whilst being sucked to the opposing electrode side, and still image forming can be attained by stably sucking the paper without depending upon change in environment.

The present invention has been devised in order to attain the above objects and the gist of the invention is as follows:

In order to achieve the above object, the present invention is configurated as follows:

In accordance with the first aspect of the invention, an image forming apparatus includes:

a supporting means for supporting developer;

an opposing electrode disposed facing the supporting means;

a control electrode disposed between the supporting means and the opposing electrode and having a plurality of electrode, each electrode surrounding a gate which forms a passage for the developer;

a conveying means for conveying a recording medium on which an image is recorded, into a space between the control electrode and the opposing electrode; and a controlling means which generates a predetermined potential difference between the supporting means and the opposing electrode and, by varying the potential applied to the control electrode, controls passage of the developer through each of the gates to form an image on the recording medium being conveyed between the control electrode and the opposing electrode, characterized in that the conveying means includes:

an input conveying means, disposed on the upstream side of the opposing region between the opposing electrode and the control electrode with respect to the conveying direction of the recording medium, for feeding the recording medium into the space between the control electrode and the opposing electrode;

an output conveying means disposed on the downstream side of the opposing region between the opposing electrode and the control electrode with respect to the conveying direction of the recording medium, for discharging the recording medium from the space between the control electrode and the opposing electrode; and a sucking means disposed between the input conveying means and the output conveying means for suction-holding the recording medium at a predetermined position between the control electrode and the opposing electrode, and is characterized in that the input conveying means and the output conveying means are arranged so that the distance between the two is shorter than the length of the recording medium with respect to the conveying direction, and the sucking means comprises a chamber having a suction port which is provided near the opposing electrode and an outlet port and a decompressing means disposed in proximity to the outlet port for reducing the pressure inside the chamber so that the air inside the chamber is exhausted from the outlet port by means of the decompressing means to reduce the pressure in the chamber to thereby suck the recording medium to the suction port.

In accordance with the second aspect of the invention, the image forming apparatus having the above first feature, comprises a sucking means, disposed between the input conveying means, and the output conveying means for suction-holding the recording between medium at a predetermined position between the control electrode and the opposing electrode, and is characterized in that at least the suction port forming edges located across the conveying direction of the recording medium are beveled in such a manner that the suction port becomes narrowed in the air sucking direction.

In accordance with the third and fourth aspects of the invention, the image forming apparatus having the above first or second feature is characterized in that the sucking means has an opening formed in the chamber, accommodates at least part of the opposing electrode in the opening and uses the opening portion other than the accommodating portion as the suction port.

In accordance with the fifth aspect of the invention, the image forming apparatus having the above first feature, further comprises a guiding member which is formed such that the gap between the chamber and itself becomes narrowed as it approaches toward the downstream side with respect to the conveying direction of recording medium, and which has an end on the conveyance downstream side extending to the region where the force of sucking the recording medium to the suction port is strong enough.

In accordance with the sixth aspect of the invention, the image forming apparatus having the above first feature is characterized in that the sucking means has a plurality of chambers and the outlet ports of neighboring chambers are formed adjacent to each other so that one decompressing means is provided in proximity with the grouped outlet ports so as to reduce the pressure in each of the grouped chambers.

In accordance with the seventh aspect of the invention, the image forming apparatus having the above first feature is characterized in that the sucking means has a plurality of chambers, grouped in two parts each having one decompressing means, and the groups are arranged upstream and downstream of the opposing electrode with respect to the conveying direction of the recording medium.

In accordance with the eighth aspect of the invention, the image forming apparatus having the above first feature is characterized in that the sucking means has a plurality of chambers, the chambers and the decompressing means are arranged perpendicularly to the conveying direction of the recording medium.

In accordance with the ninth aspect of the invention, the image forming apparatus having the above first feature is characterized in that the sucking means has a plurality of chambers and decompressing means, the boundaries of the chambers reside within the width of the recording medium to be conveyed and are positioned in the proximity to the side edges of the recording medium.

In accordance with the tenth through fourteenth aspects of the invention, the image forming apparatus having the above first and sixth to ninth feature is characterized in that the decompressing means for reducing the pressure in the chamber can be operated other than during conveying the recording medium so that the air sucked from the suction port is discharged out of the apparatus.

In accordance with the fifteenth through nineteenth aspects of the invention, the image forming apparatus having the above tenth through fourteenth feature is characterized in that the open area of the suction port can be changed in size.

In accordance with the twentieth through twenty-fourth aspects of the invention, the image forming apparatus having the above tenth through fourteenth feature further comprises an exhaust outlet passage for discharging the air from the chamber by means of the decompressing means to the exterior of the apparatus and an output tray which receives the recording medium with images formed thereon and is provided so as to cover the exhaust outlet passage but not to block the outlet opening thereof.

In accordance with the twenty-fifth aspect of the invention, the image forming apparatus having the above first feature is characterized in that the opposing electrode and a least part of the sucking means are integrally formed as a single unit which is detachable.

In accordance with the twenty-sixth aspect of the invention, the image forming apparatus having the above first feature is characterized in that plural colors of developers are used and a set of the supporting means and opposing electrode is provided for each color, and the decompressing means is adapted for air-suction even from the space between the supporting means and opposing electrode which are not engaged in printing.

In accordance with the twenty-seventh aspect of the invention, an image forming apparatus comprises:

a supporting means for supporting developer;

an opposing electrode disposed facing the supporting means for creating an electric field in cooperation with the supporting means;

a control electrode disposed in the transfer routes of the developer jumping from the supporting means toward the opposing electrode;

a recording medium conveying means for feeding a recording medium (recording paper) to the major surface of the opposing electrode, wherein the potential of the control electrode is controlled in accordance with an image signal to form an image on the recording medium; and a support for supporting a support surface which is arranged approximately flush with the major surface of the opposing electrode so as to support the recording medium and define the opening of the suction port; and a sucking means for sucking air through the suction port so as to attract the recording medium to the support surface, and is characterized in that a plurality of grooves which are arranged in parallel to the conveying direction of the recording medium are formed in each support surface, on the downstream side of the recording medium conveying means with respect to the conveying direction.

In accordance with the twenty-eighth aspect of the invention, the image forming apparatus having the above twenty-seventh feature is characterized in that a plurality of suction ports are arranged in the conveying direction of the recording medium (recording paper) or perpendicularly to the conveying direction thereof.

In accordance with the twenty-ninth and thirtieth aspects of the invention, the image forming apparatus having the above twenty-seventh and twenty-eighth feature is characterized in that the grooves are formed on the downstream side of each suction port with respect to the conveying direction of the recording paper.

In accordance with the thirty-first through thirty-fourth aspects of the invention, the image forming apparatus having the above twenty-seventh through thirtieth feature is characterized in that the suction port is formed so as to communicate with the grooves.

In accordance with the thirty-fifth through forty-second aspects of the invention, the image forming apparatus having the above twenty-seventh through thirtieth feature is characterized in that a slanted surface is provided in the groove end face located on the downstream side with respect to the conveying direction of the recording paper.

The above configurations of the invention operate in the following manner.

In the first configuration of the invention, input and output conveying means and a sucking means independent of the opposing electrode are used to convey recording medium instead of using the opposing electrode as the attraction conveying means of recording medium as has been done in the prior art. Accordingly, it is possible to convey the recording medium keeping it at a predetermined position even when the sucking strength is regulated so that the airflow drawn from the suction port in the sucking means over which no recording medium is present is adjusted so as not to stir the developer on the supporting means and the control electrode. Further, since the opposing electrode having a flat surface which is ideal for image forming is used in place of a curved one, an excellent image can be formed.

In the second configuration of the invention, even when the front end of the recording medium almost enters the suction port during the conveyance of the recording medium, the beveled surface abuts the front end of the recording medium so as to revert it back along the slanted surface to its due conveyance path.

In the third and fourth configurations of the invention, since the opposing electrode is accommodated inside the chamber, it defines part of the suction port. That is, the side portions of the opposing electrode constitute suction ports. Consequently, the recording medium can be sucked in the closest position to the opposing electrode, thus making it possible to attain excellent conveyance of the recording medium.

In the fifth configuration of the invention, the guiding member is positioned so as to guide the recording medium to the region where the recording medium can be sucked to the suction port. Accordingly, it is possible to suck the recording medium to the suction port without sucking failure even if it has curls or wrinkles.

In the sixth configuration of the invention, a plurality of chambers share one decompressing means. Accordingly, this configuration needs fewer number of decompressing means compared to the case where each chamber has its own decompressing means. Thus, the number of parts can be reduced. Further, since there are plural chamber, it is possible to maintain the decompressed state in the other chambers even when one of the plural chambers opposite the decompressing means is left open.

In the seventh configuration of the invention, since a pair of sets of the decompressing means and the chambers are disposed upstream and downstream of the opposing electrode, it is possible to attain excellent suction conveyance without lowering the sucking force even when the recording medium is present over only one of the suction ports located upstream and downstream of the opposing electrode.

In the eighth configuration of the invention, since the decompressing means are arranged perpendicularly to the conveying direction of the recording medium, it is possible to avoid reduction of sucking force in other chambers even when a narrow-width recording medium is used and hence part of the suction port is left open.

In the ninth configuration of the invention, since a plurality of chambers are provided in correspondent with the sizes of recording medium, it is possible to suck the almost entire part of the recording medium whatever the size of the recording medium to be conveyed is.

In the tenth through fourteenth configurations of the invention, airflow toward the suction port is utilized to easily collect the developer particles scattered around the control electrode and the opposing electrode. In particular, by continuously operating the decompressing means during the cleaning of the electrode or when the system has been stopped due to malfunction such as paper jam, it is possible to collect the developer particles scattered in the machine body, thus preventing the developer from staining the opposing electrode and hence causing no smudges on the rearside of the recording medium. Further, by continuously operating the decompressing means, hot air generated from the heat emitters such as the fixing means and power sources can be sucked from the suction port, thus making it possible to cool down the apparatus without providing a separate cooling means.

In the fifteenth through nineteenth configurations of the invention, by enlarging the open area of the suction port during the cleaning operation, for example, it is possible to improve the collection of the disposed developer particles.

In the twentieth through twenty-fourth configurations of the invention, the outlet port for discharging air from the apparatus interior and the output tray of the recording medium are disposed on the same plane. The output tray can also work as the blocking member for preventing the developer from being discharged from the outlet port.

In the twenty-fifth configuration of the invention, since the opposing electrode and the sucking means are formed as a single unit, it is possible to exchange the whole unit without needing parts by parts maintenance. Accordingly, a typical user can easily handle the apparatus.

In the twenty-sixth configuration of the invention, the decompressing means can suck air even from the space in the set of the supporting means and opposing electrode which are not engaged in printing. For example, if the control electrode is cleaned simultaneously with other operations, collection of dispersed developer particles can be made as well, so as to avoid color mixing and blur due to the developer particles scattered during cleaning. Further, by continuously operating the decompressing means, hot air generated from the heat emitters such as the fixing means and power sources can be sucked from the suction port, thus making it possible to cool down the apparatus.

In accordance with the image forming apparatus according to the twenty-seventh feature of the invention, the recording paper is delivered by the paper conveying means to the major surface of the opposing electrode whilst it is supported by the support surfaces of the supports. The recording medium is attracted to the support surfaces of the supports since the sucking means sucks air from the suction ports opening in the support surfaces. Accordingly, the recording medium is conveyed whilst being attracted to the supports.

In this case, although the friction between the recording paper and the support surfaces is increased due to the attraction of sucking means, since grooves in parallel with the conveying direction of the recording paper are formed on the support surface, the contact area between the recording paper and the support surfaces is reduced. As a result, the conveyance of the recording paper is effected with the friction reduced.

In accordance with the image forming apparatus according to the twenty-eighth feature of the invention, the recording paper is sucked in the direction along which a plurality of suction ports are arranged.

In the image forming apparatus according to the twenty-ninth and thirtieth features of the invention, the front end of the recording paper will not be sucked effectively after it has passed by the suction port and hence it becomes unstable. however, since the grooves are formed on the downstream side of the suction port, it is possible to reduce the friction between the front end of the recording medium and the support, and deliver it out without causing any vibration of the recording paper.

In accordance with the image forming apparatus according to the thirty-first through thirty-fourth features of the invention, since the grooves are made to communicate with the suction port, it is possible for the sucking means to suck air through the grooves and hence the recording paper is attracted to the suction port and the grooves.

In accordance with the image forming apparatus according to the thirty-fifth through forty-second features of the invention, since a slanted surface is provided in the groove end face, the conveyance of the recording paper will not be hindered even if the front end of the recording paper enters the grooves.

DESCRIPTION OF THE PREFERRED EMBODIMENTS

Figure 1:
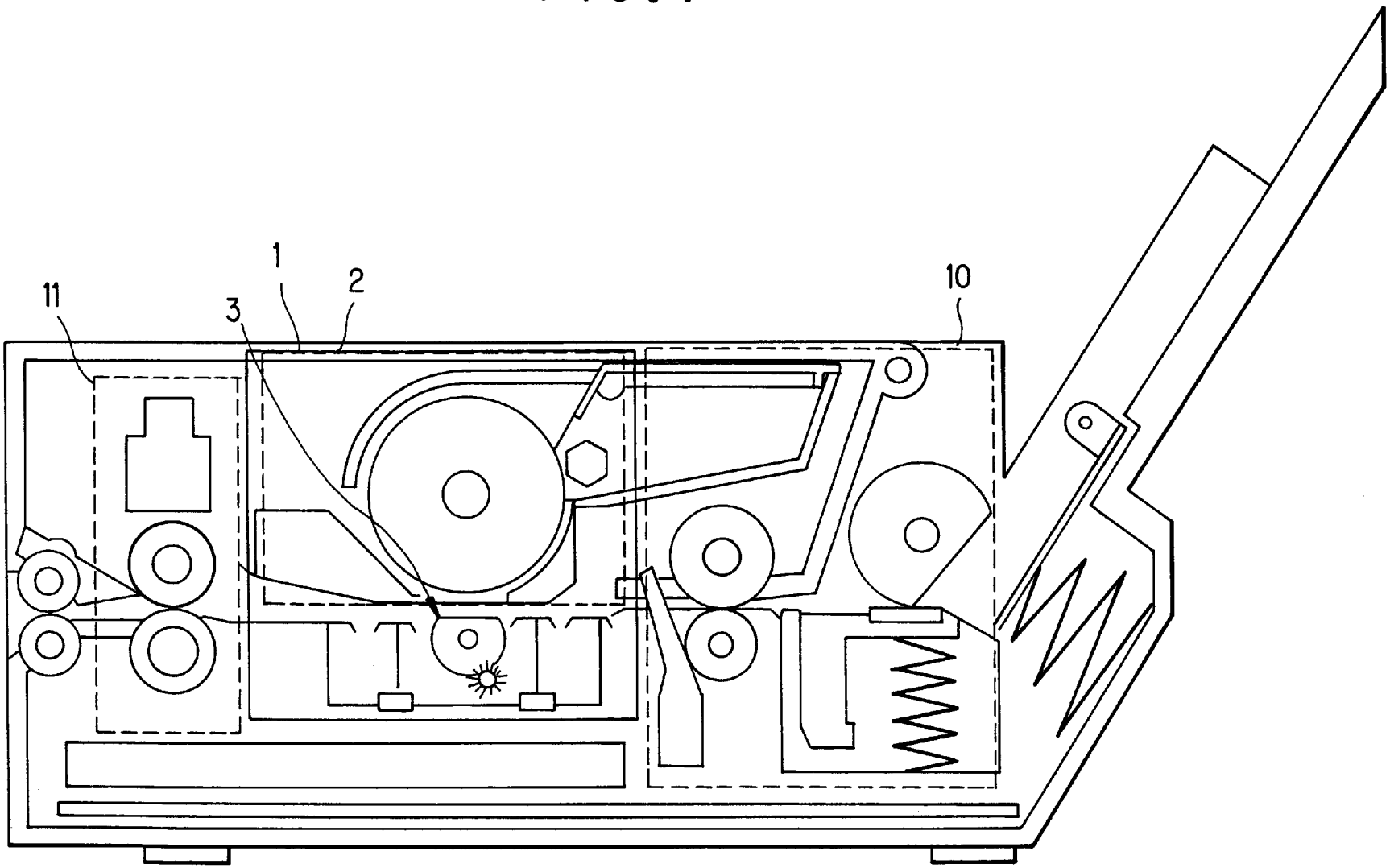
FIG. 1 is an overall configurational view showing one embodiment of a printer as the image forming apparatus of the invention.

The embodiment of the invention will hereinafter be described in detail with reference to the accompanying drawings.

In each of the drawings, the same components or those corresponding are designated by the same reference numerals so that these components will not be described repeatedly.

Figure 2:
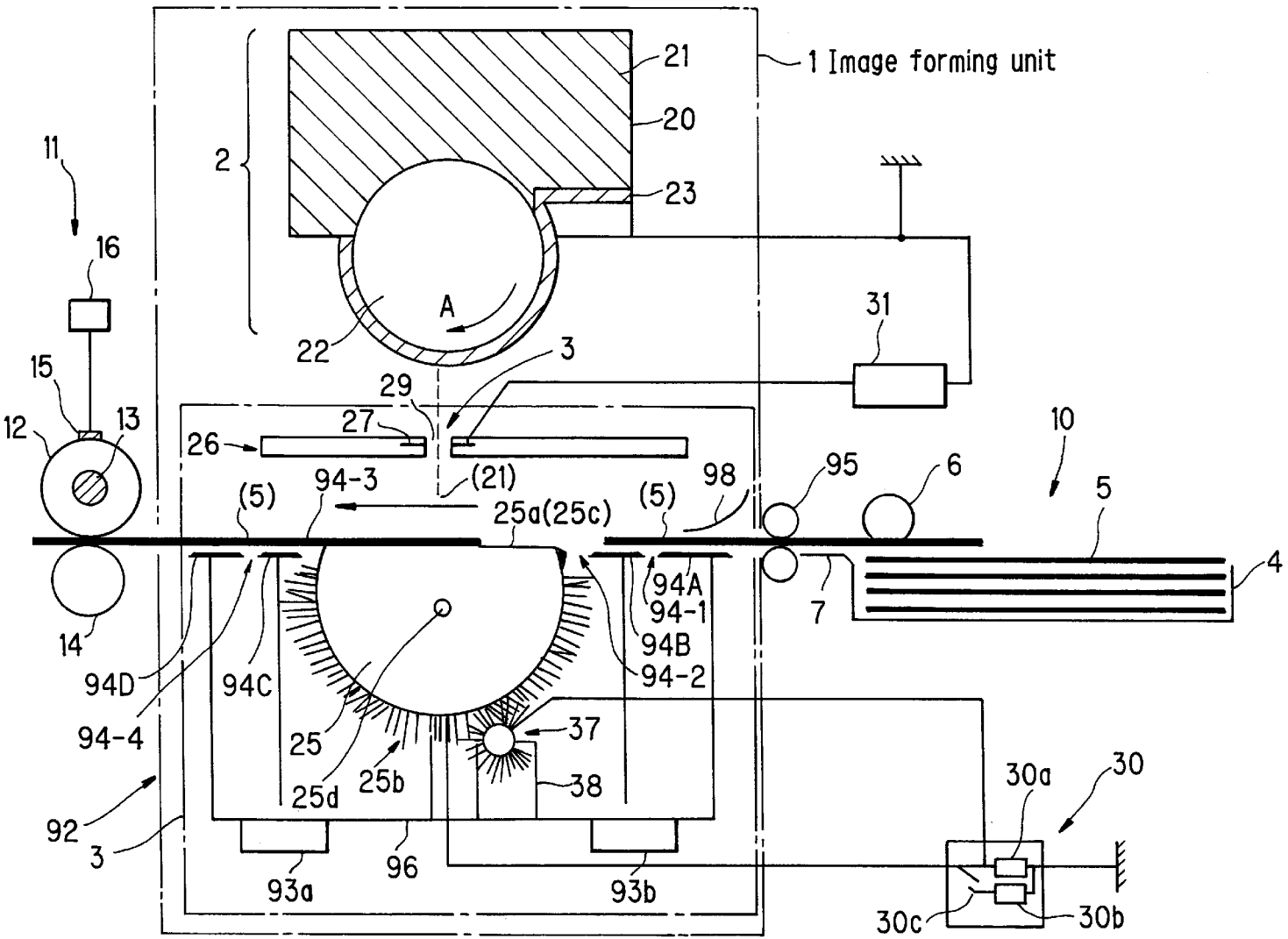
FIG. 2 is a schematic diagram showing essential components disposed around the image forming unit of the printer.

FIG. 1 is an overall configurational diagram showing one embodiment of a printer as an image forming apparatus of the invention. FIG. 2 is a schematic diagram showing essential components around the image forming unit of the printer. In the following description, an image forming apparatus configured for negatively charged toner will be detailed. When this invention will be applied to a configuration where positively charged toner is used, polarities of applied voltages should be appropriately selected.

This image forming apparatus has an image forming unit 1 which is composed of a toner supplying section 2 and a printing section 3. Image forming unit 1 creates a visual image in accordance with an image signal, onto a sheet of paper as recording medium with toner as the developer. In this image forming apparatus, the toner 21 is made to jump and adhere onto the paper whilst the jumping of the toner is controlled based on the image signal, so as to directly form the image on the paper.

Provided on the paper input side of image forming apparatus 1 is a paper feeder 10 as the paper supplying and conveying means. As shown in FIG. 2, paper feeder 10 is composed of a paper cassette 4 for storing recording paper 5 as recording medium, a pickup roller 6 for delivering recording paper 5 from paper cassette 4, a paper guide 7 for guiding recording paper 5 sent out and a resist roller 95. Paper feeder 10 further has an unillustrated paper feed sensor for detecting the feed of recording paper 5. Pickup roller 6 is rotationally driven by means of an unillustrated driver.

Provided on the output side of image forming apparatus 1 from which recording paper 5 is outputted, is a fixing unit 11 for heating and pressing the toner image which was formed on recording paper 5 at the image forming unit 1, to fix it onto recording paper 5 and output the fixed paper. Fixing unit 11 also serving as the paper output conveying means is composed of a heat roller 12, a heater 13, a press roller 14, a temperature sensor 15, and a temperature controller circuit 16. Heat roller 12 is made up of, for example, an aluminum pipe of 2 mm thick. Heater 13 is a halogen lamp, for example, which is incorporated in heat roller 12. Press roller 14 is a pipe made up of silicone resin. Heat roller 12 and press roller 14 which are arranged opposite each other, are pressed against one another in order to hold recording paper 5 in between and press it, with a pressing load, e.g. 2 kg, from unillustrated springs etc., provided at both ends of their shafts. Temperature sensor 15 measures the surface temperature of heat roller 12. Temperature controller circuit 16 is controlled by a main controller, which will be described later, and performs the on/off operation of heater 13 or other control based on the measurement of temperature sensor 15, thus maintaining the surface temperature of heater roller 12 at, for example, 150° C. Fixing unit 11 has a paper discharge sensor (not shown) for detecting the discharge of recording paper 5.

Further, although it is not shown in the drawing, the paper output side of fixing unit 11 has a paper discharge roller for discharging recording paper 5 processed through fixing unit 11 onto a paper output tray and a paper output tray for holding recording paper 5 thus discharged. The aforementioned heat roller 12, press roller 14 and the paper discharge roller are rotated by an unillustrated driving means.

Here, the materials of heat roller 12, heater 13, press roller 14, etc., are not limited to those mentioned above. The surface temperature of heat roller 12 also is not limited to that mentioned above. Further, fixing unit 11 may use a fixing process in which the toner image is pressed and fixed onto recording paper.

Toner supplying section 2 as part of image forming apparatus 1 is composed of a toner storage tank 20 for storing toner 21 as the developer, a toner support 22 of a cylindrical sleeve for magnetically supporting toner 21, a doctor blade 23 which is provided inside toner storage tank 20 to electrify toner 21 and regulate the thickness of the toner layer carried on the peripheral surface of toner support 22. Doctor blade 23 is arranged on the upstream side of toner support 22 with respect to the rotational direction, spaced with a distance of about 60 $\mu$m, for example, from the peripheral surface of toner support 22. Toner 21 is of a magnetic type having a mean particle diameter of, for example, 6 $\mu$m, and is electrified with static charge of −4 $\mu$C/g to −5 $\mu$C/g by doctor blade 23. Here, the distance between doctor blade 23 and toner support 22 is not limited to the above value. The mean particle size, the amount of static charge, etc., of toner 21 are not particularly limited to the above ranges.

Toner support 22 is rotationally driven by an unillustrated driving means in the direction indicated by arrow A in the figure, with its surface speed set at about 100 mm/sec, for example. Toner support 22 is grounded and has unillustrated fixed magnets therein, at the position opposite doctor blade 23 and at the position opposite a control electrode 26 (which will be described later). This arrangement permits toner support 22 to carry toner 21 on its peripheral surface. Here, the toner is supported by magnetic force, but toner support 22 can be configured so as to support toner 21 by electric force or combination of electric and magnetic forces.

The printer as the image forming apparatus includes: a main controller as a control circuit for controlling the whole image forming apparatus; an image processor for converting the image data obtained from image pickup device for reading the image of an original etc., into a format of image data to be printed; an image memory for storage of the converted image data; and an image forming control unit for converting the image data obtained from the image processor into the image data to be given to control electrode 26.

Printing section 3 of image forming unit 1 includes: an opposing electrode 25 which has a flat part 25*a* arranged in parallel with the peripheral surface of toner support 22; a high-voltage power source 30 for applying a high voltage to opposing electrode 25; and a control electrode 26 provided between toner support 22 and opposing electrode 25; a cleaning brush 25*b*. Here, opposing electrode 25 is formed of aluminum, for example.

The above flat part 25*a* is positioned 1.1 mm, for example, apart from the peripheral surface of toner support 22. The surface of flat part 25*a* has a fluororesin coating layer having a volume resistivity of $10^8\Omega\cdot$cm and a thickness of 75 $\mu$m, coated thereon. Opposing electrode 25 is driven by means of an unillustrated driver through a rotary shaft 25*d* so as to rotate in the direction of arrow B in the figure. Cleaning brush 25*b* is arranged so that it can be in contact with control electrode 26 when positioned opposite to control electrode 26. Opposing electrode 25 has a high voltage, e.g. 2 kV applied thereto from high-voltage power source (control means) 30. That is, the high voltage applied from high voltage power source 30 creates an electrical field necessary for causing toner 21 carried on the peripheral surface of toner support 22 to jump toward opposing electrode 25, between opposing electrode 25 and toner support 22.

Provided in proximity with the opposing electrode 25 are a cleaning means 37 with its supporting portion 38. The same voltage as applied to opposing electrode 25 during printing, is also applied continuously during the apparatus' operation to cleaning means 37 from high-voltage power source 30. Here, the material of the fluororesin coating layer of flat part 25*a* of opposing electrode 25 as well as that of cleaning brush 25*b* should not be particularly limited as long as full operational functionality is assured without deviating from the scope of the invention. Further, the distance between opposing electrode 25 and toner support 22, and the applied voltage should not be particularly limited to the values stated above.

Control electrode 26 is disposed in parallel to the tangent plane of the surface of opposing electrode 25 and spreads two-dimensionally facing opposing electrode 25, and it has a structure to permit the toner to pass therethrough from toner support 22 to opposing electrode 25. The field formed between toner support 22 and opposing electrode 25 varies depending on the potential being applied to control electrode 26, so that the jumping of toner 21 from toner support 22 to opposing electrode 25 is controlled. Control electrode 26 is arranged so that its distance from the peripheral surface of toner support 22 is set at 100 $\mu$m, for example, and is secured by means of an unillustrated supporter member.

Figure 3:
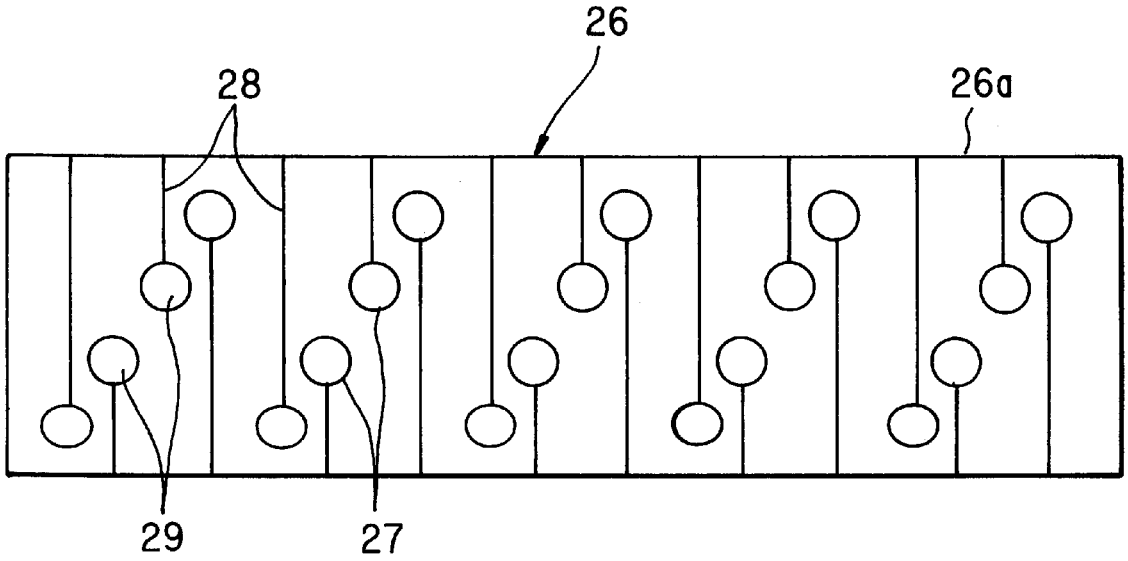
FIG. 3 is a schematic view of a control electrode.

FIG. 3 is a structural view showing the control electrode. Control electrode 26 is composed of an insulative board 26*a*, annular conductors independent of one another, i.e., annular electrodes 27, gates 29 formed inside each annular electrode 27, feeder lines 28 as cables, connected to annular electrodes 27 and a high voltage driver (not shown). Board 26*a* is made from a polyimide resin, for example, with a thickness of 25 $\mu$m. Board 26*a* further has passage holes forming gates 29, to be described later, formed therein. Annular electrodes 27 are formed of copper foil, for instance, and are arranged in a predetermined layout around each of the holes on the surface of board 26*a* which faces toner support 22. Each annular electrode 27 is formed 220 μm in diameter and 30 μm thick, for example. Each gate 29 provided as a passage hole in annular electrode 27 is set at 200 μm in diameter, for example, forming a passage for toner 21 to jump from toner support 22 to opposing electrode 25. Here, the distance between control electrode 26 and toner support 22 is not specifically limited to the above value. Also, the size of gates 29 and the materials and thickness of board 26*a* and annular electrodes 27 are not particularly limited to the above values.

Gates 29, or annular electrodes 27 are formed at 2,560 sites, for example. Each annular electrode 27 is electrically connected to a control power source 31 (to be described later) via feeder line 28 and a high voltage driver (not shown). The aforementioned number corresponds to a resolution of 300 DPI (dot per inch) across the width of A4 sized paper. Here, the number of annular electrodes 27 is not particularly limited to the above value.

The surface of annular electrodes 27 as well as the surface of feeder lines 28 is coated with an insulative layer (not shown) of 30 μm thick, thus ensuring insulation between annular electrodes 27, insulation between feeder lines 28, and insulation between annular electrodes 27 and feeder lines 28 which are not connected to each other. The material, thickness etc., of this insulative layer are not particularly limited.

Supplied to annular electrodes 27 of control electrode 26 are voltages or pulses in accordance with the image signal from control power source (controlling means) 31. Specifically, when toner 21 carried on toner support 22 is made to pass toward opposing electrode 25, a voltage, e.g., 150 V is applied to annular electrodes 27. When the toner is blocked to pass, a voltage, e.g., −200 V is applied. In this way, whilst the potential to be imparted to control electrode 26 is controlled in accordance with the image signal, a sheet of recording paper 5 is fed along opposing electrode 25 on the side thereof facing toner support 22. Thus, a toner image is formed on the surface of recording paper 5 in accordance with the image signal. Here, control power source 31 is controlled by a control electrode controlling signal transmitted from an unillustrated image forming control unit.

Figure 4:
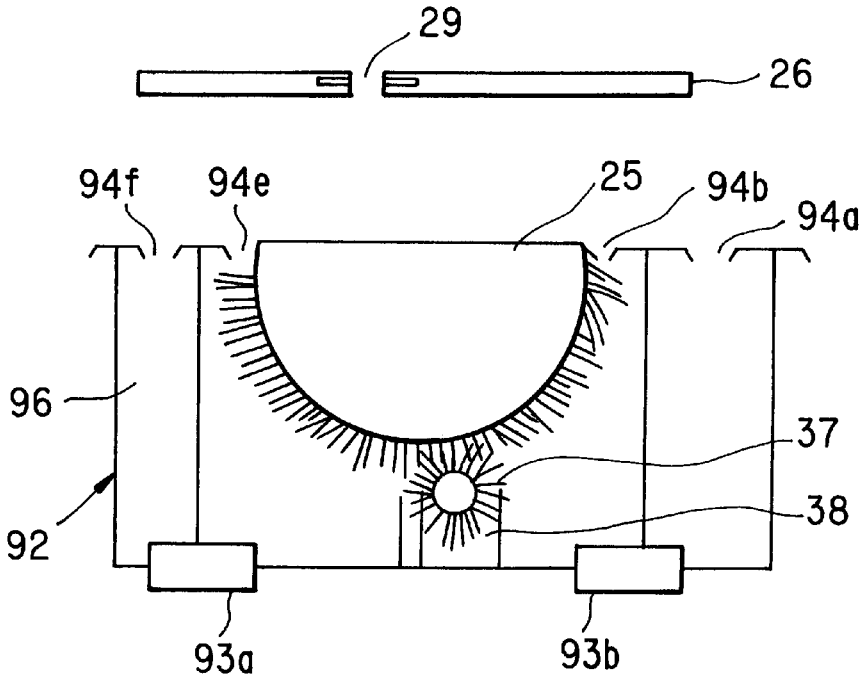
FIG. 4 is an enlarged schematic diagram showing a paper sucking portion.

Further, this printer has a paper suction portion 92 which conveys paper 5 whist keeping it at a predetermined positional relation in contact with the flat part 25*a* side. FIG. 4 is an enlarged structural view showing the paper suction portion. Paper suction portion 92 includes fans 93*a* and 93*b* as decompressing means and a chamber 96 with a plurality of suction ports 94 disposed therein, through which air is sucked so that paper 5 will not be in contact with control electrode 26. The image forming apparatus here is applied to a printing portion of a printer, but it can be used for the printing portion of facsimile machines and digital copiers.

Figure 5:
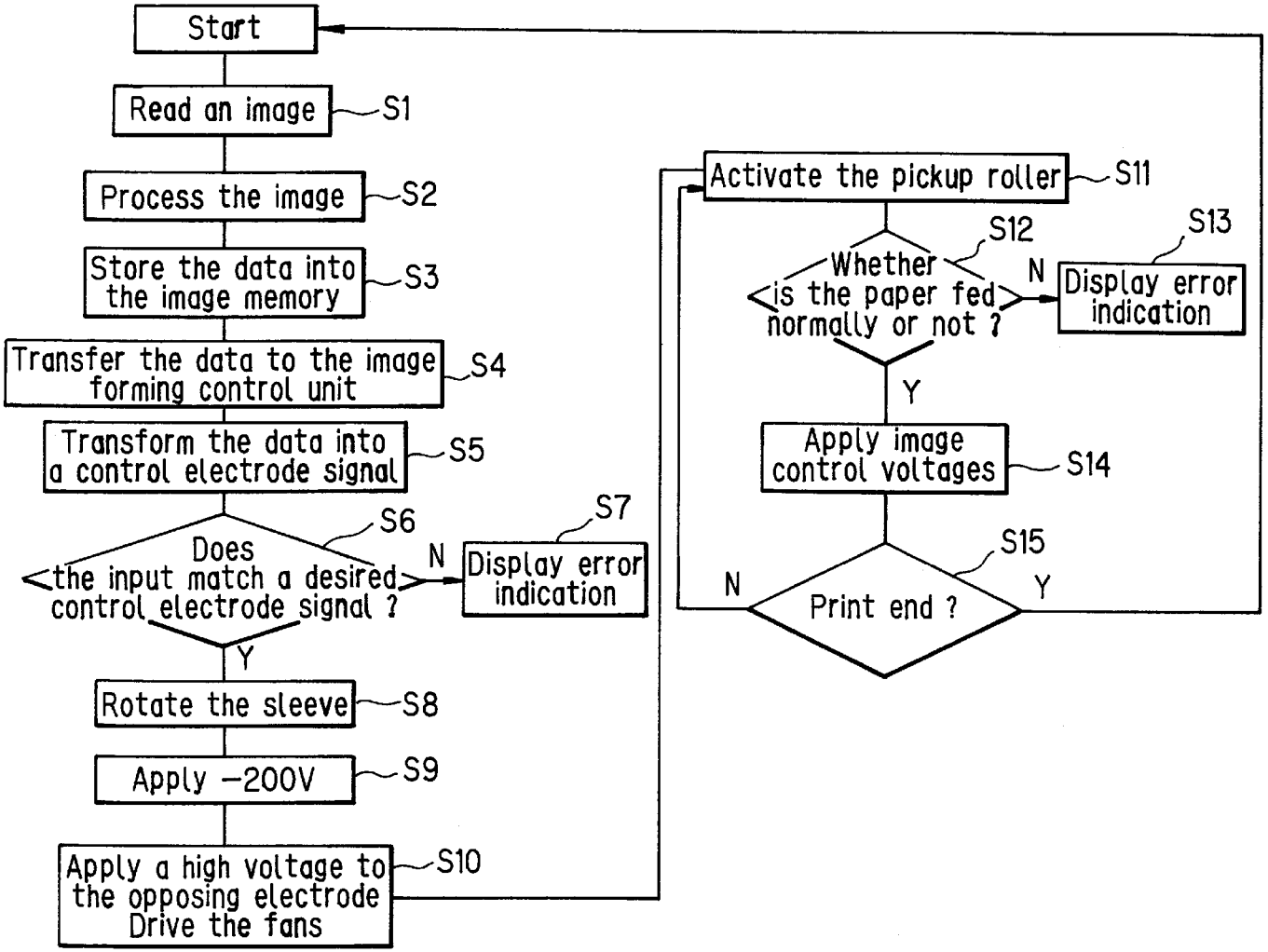
FIG. 5 is a flowchart showing the image forming operation in the image forming apparatus.

FIG. 5 is a flowchart showing the procedural flow of the image forming operation of the image forming apparatus which is used as the printing portion of a digital copier, for example. Description will be made following this flowchart. First, when, for example, an original to be copied is placed on the image pickup section and the copy start key (not shown) is operated, the main controller receives this input and starts to perform the image forming operation. Illustratively, the image pickup section reads the image of the original (Step S1), and the image data is processed in the image processing section (Step S2) to be stored into the image memory (Step S3).

This image data stored in the image memory is transferred to the image forming control unit (Step S4) so that the image forming control unit starts to transform the input image data into a control-electrode controlling signal to be imparted to control electrode 26 (Step S5). When the image forming control unit has obtained a predetermined amount of the control-electrode controlling signal, it judges whether the signal is a desired control electrode signal (Step S6). If the signal is not a desired control electrode signal, an error message is displayed (Step S7). If the signal is a desired control electrode signal, the sleeve is started to rotate (Step S8) and a voltage of −200 V is applied (Step S9) while toner support 22 and fans 93 are activated (Step S10). At the same time, an unillustrated driver is started to operate. In this case, a predetermined level of high voltage is applied to opposing electrode 25 so as to operate the recording paper attracting mechanism. The rotation of pickup roller 6 shown in FIG. 2 which is driven by a driver, delivers a sheet of paper 5 out from paper cassette 4 toward image forming unit 1 (Step S11). Then it is judged whether the paper was fed normal or not (Step S12). If the paper is not fed normally, an error message is displayed (Step S13). Paper 5 picked up by pickup roller 6 is sent out by a resist roller 95, and then it is conveyed to the printing section 3 of image forming apparatus 1, specifically along the side of the flat part 25*a* facing toner support 22 whilst it has air suction from air sucking means 92. Here, the aforementioned predetermined amount of the control-electrode controlling signal varies depending upon the configuration etc. of the image forming apparatus.

Subsequently, the image forming control unit supplies the created control-electrode controlling signal to control power source 31. This supply of the control-electrode controlling signal is synchronized with the conveyance of paper 5 to printing section 3. Control power source 31 controls the application of high voltage to annular electrodes 27 of each control electrode 26 in accordance with the control-electrode controlling signal (Step S14). More specifically, a voltage of 150 V or −200 V is selectively applied to each of annular electrodes 27 from control power source 31, thus controlling the intensity of the electric field near control electrode 26. That is, at each gate 29 of control electrode 26, the jumping of toner 21 from toner support 22 toward opposing electrode 25 is appropriately inhibited or permitted in accordance with the image data, whereby the toner image, in conformity with the image signal, is formed on the surface of paper 5 which is moving at the rate of 30 mm/sec toward the paper output side by the rotational movement of resist roller 95.

Paper 5 with the toner image formed thereon is conveyed to fixing unit 11, where the toner image is fixed to paper 5. Paper 5 with the toner image fixed thereon is discharged by the discharge roller onto the paper output tray. This, i.e., the normal discharge of the paper is detected by a paper discharge sensor. Based on this detection, the main controller determines that the printing operation has been normally finished (Step S15).

Thus, the image forming operation produces a good image on paper 5. In this image forming apparatus, since the image is directly formed on paper 5, it is no longer necessary to use any photoreceptor or dielectric drum etc., as the developing medium. Accordingly, the transfer operation of the toner image from the developing medium is omitted, no degradation of image occurs. Therefore, the reliability of the apparatus is improved. Further, the configuration of the apparatus can be simplified needing a fewer number of parts, thus making it possible to reduce the size and cost of the apparatus.

Next, each control in the above embodiment will be described.

Figure 6:
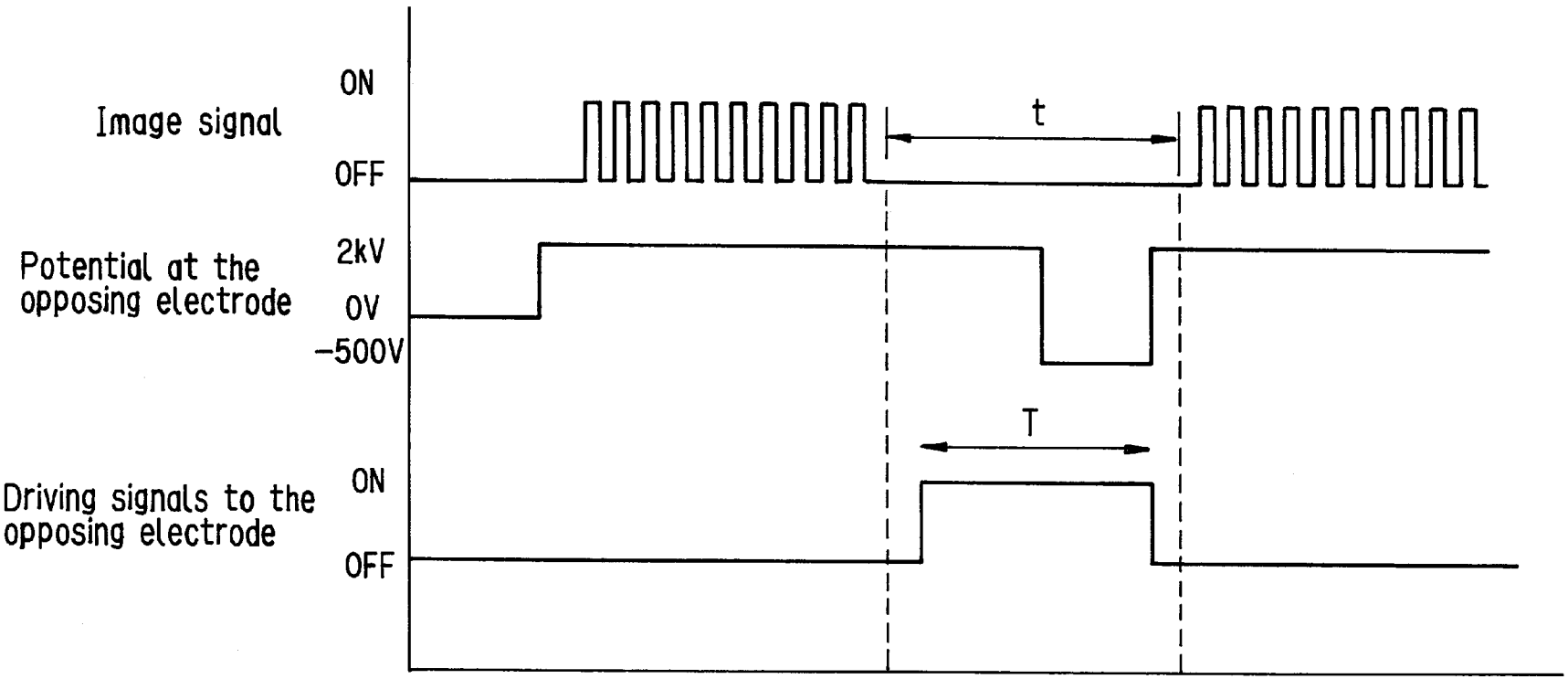
FIG. 6 is a timing chart of signals given to the opposing electrode.

FIG. 6 is a timing chart of signals to be imparted to the opposing electrode. As shown in FIG. 6, 't' designates the interruption of printing, or the interval between sheets (i.e., the interval between an already printed sheet and a next sheet). During a period of time T, which is shorter than time t, the opposing electrode driving signal is imparted so that opposing electrode 25 is controlled so as to be rotated one revolution by means of the driving means of opposing electrode 25. During this period, a high voltage is continued to be applied to opposing electrode 25 (see the potential level of the opposing electrode in FIG. 6).

Concerning the high voltage applied during this period, the polarity is switched during time T as shown in FIG. 6. In this embodiment, a cleaning power source 30*b* can supply a reversed cleaning voltage of −500 V for cleaning to cleaning brush 25*b* when it is switched on by a switching means 30*c*. When the driving of opposing electrode 25 finishes, switching means 30*c* switches voltage application from the cleaning voltage to the high voltage required for the printing operation, i.e., 2 KV output from high voltage power source 30*a*.

Figure 7:
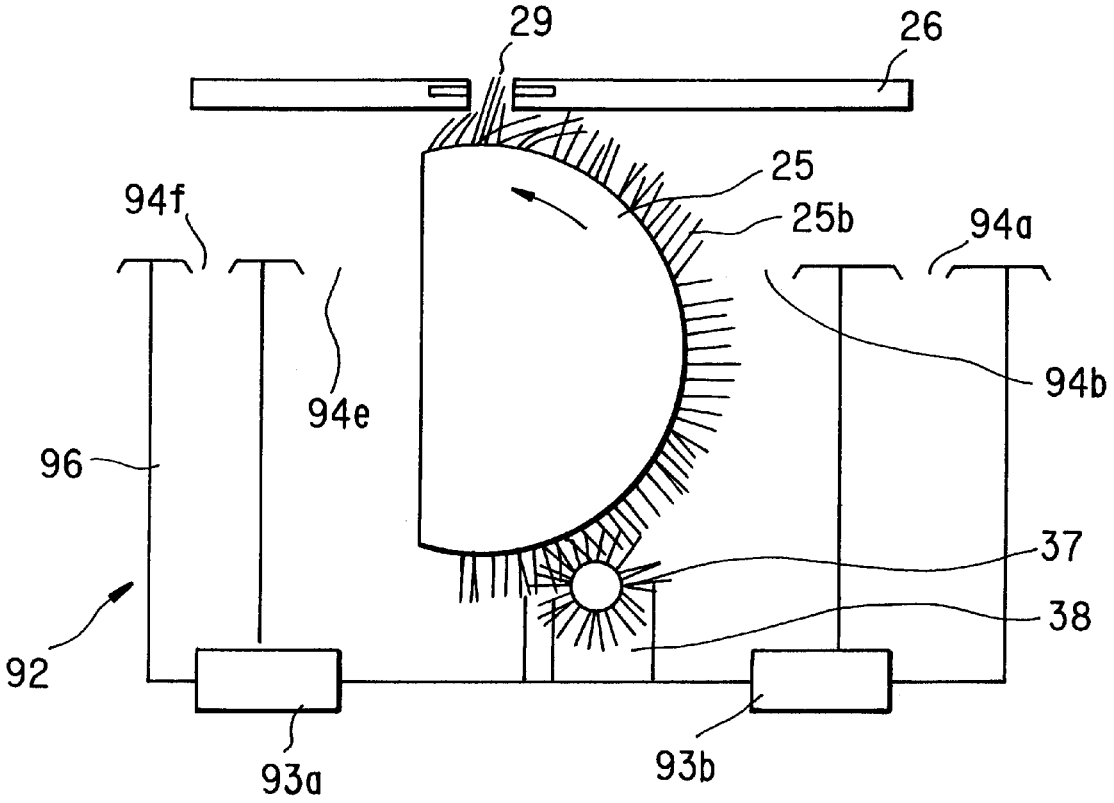
FIG. 7 is an illustrative view showing the operation of cleaning the control electrode.

In the above control, flat part 25*a* of opposing electrode 25 constantly faces control electrode 26 in parallel therewith during printing. During non-printing, in particular, in the process of rotating opposing electrode 25 in the interval between sheets as shown in FIG. 7, cleaning brush 25*b* can come in contact with control electrode 26. When cleaning brush 25*b* is located in a position where it faces control electrode 26, it is in contact with, or in close proximity with, control electrode 26. Since high voltage is applied to opposing electrode 25 also at this instant, it is possible to impart a very strong electric field to toner 21 adhering to control electrode 26, and therefore toner adhering to control electrode 26 can be easily removed by cleaning brush 25*b*. Applied to opposing electrode 25 is the same voltage as that during printing as stated above, and since the brush is in contact with or in proximity with control electrode 26, the voltage, through the front ends of cleaning brush 25*b*, generates a markedly strong electric field which affects toner 21 adhering to the control electrode much more than that generated during printing. As a result, the toner which has not been attracted to opposing electrode 25 during printing can be attracted to cleaning brush 25*b*, making it possible to clean control electrode 26. Further, since the potential of cleaning brush 25*b* is changed during cleaning as stated above, it is possible to remove toner 21 having reverse charge.

Then, cleaning brush 25*b* finally separates from control electrode 26 by the rotation of opposing electrode 25, and opposing electrode stops again at the position where flat part 25*a* faces control electrode 26 and then the next paper 5 is subjected to printing. Whilst opposing electrode 25 is rotating, cleaning means 37 is able to be in contact with cleaning brush 25*b* and flat part 25*a* so that it can clean off the toner adhering to flat part 25*a* and cleaning brush 25*b*. Applied to cleaning means 37 is the same voltage as that applied to opposing electrode 25 during printing so that the toner adhering to the cleaning brush and flat part 25*a* can also be removed electrically. Cleaning member 37 may be composed of a blade-like member.

In the above embodiment, paper 5 is attracted by suction portion 92 in order to press paper 5 onto opposing electrode 25. In the image forming apparatus of the above type, the distance between control electrode 26 and paper 5 has a great influence on printing performance. When plain paper or the like is used as paper 5, the relative position of paper 5 to control electrode 26 or opposing electrode 25 will vary due to its wrinkles, curls, elasticity, etc. and also due to electric force the charge on paper 5 receives. Although such a displacement is very small, but since the distance between control electrode 26 and opposing electrode 25 is very short, i.e., 1 mm or less, the displacement may be great compared to the distance. When the position of paper 5 moves, the printed dots change in shape and size, possibly causing failure to form a desired image. That is, the change in shape and size of dot formation lowers the reproduction performance of halftones, resulting in failure to create correct halftones and hence giving rise to difficulty in forming satisfactory images.

When paper 5 further deviates from its proper position, it even could come into contact with control electrode 26. In such a case, the toner which has already transferred to paper 5 will be rubbed due to its contact with control electrode 26 causing image destruction. Besides, the toner adhering to control electrode 26 will adhere to paper 5, thus causing background fogginess or causing black lines and black spots when there is a heavy stain of toner. Further, if paper 5 and control electrode 26 come in contact with each other, charge will be induced onto the surface of control electrode 26 so that the surface may collect charge. In this case, since the charge on the surface of the control electrode 26 is of a different potential relative to control electrode 26, the apparent potential of control electrode 26 relative to the toner 21 supported on toner support 22 deviates from the correct voltage (the voltage applied to control electrode 26) due to the potential of the toner relative to control electrode 26. As a result, even when the voltage for allowing passage of toner through gates 29 is applied, the toner does not jump sufficiently or not at all, causing image defects or printing failure and hence resulting in difficulty in image forming. Even when the image is formed, the resultant image becomes blurred lacking contrast and gives rise to difficulty in reproducing halftones because of insufficiency of toner transfer.

Further, when the apparatus is placed in a high temperature/high humidity environment, paper 5 to be used absorbs moisture and hence has a reduced resistance, whereby the control electrode 26 and opposing electrode 25 becomes conducting through paper 5. As a result, the high voltage on the opposing electrode 25 will leak to control electrode 26, causing destruction of control electrode 26, control circuit and other devices and further destroying the other appliances connected to this apparatus. In the worst case, the user might be struck by electricity. Therefore, it is essential to convey paper 5 whilst it is in close contact with opposing electrode 25. For this purpose, there has been an idea that paper 5 should be electrostatically attracted to opposing electrode by electrostatic force whilst it is conveyed. However, this method involves a potential drawback that the surface potential of paper 5 is liable to be unstable and also needs a charger means and charger power source for imparting charge to paper 5, simply increasing the number of parts, the size and cost of the apparatus.

In order to solve the above drawbacks, the apparatus of this invention uses a paper suction portion 92 for air suction and conveys paper 5 by making it slide along flat part 25*a* of opposing electrode 25 itself being low in friction with paper 5. Paper suction portion 92 includes a pair of fans 93*a* and 93*b* as decompressing means. As shown FIG. 8 which is a top view of paper suction portion 92, four chambers (96*a* to 96*h*) and suction ports (94*a* to 94*h*) are arranged facing each fan 93*a* and 93*b*. Fans 93*a* and 93*b* are arranged upstream and downstream of opposing electrode 25 with respect to the sheet conveying direction of paper 5.

Figure 8:
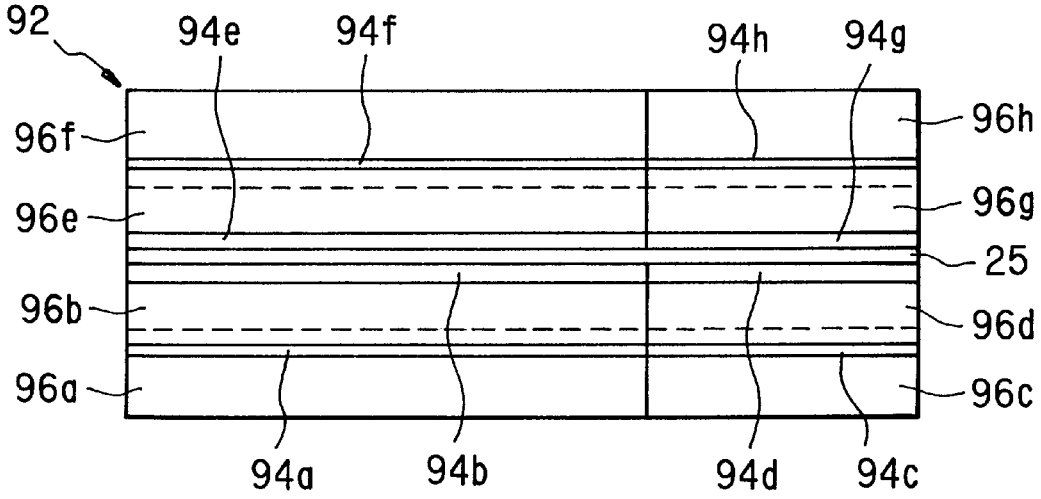
FIG. 8 is a top view of a paper sucking portion.
Figure 9:
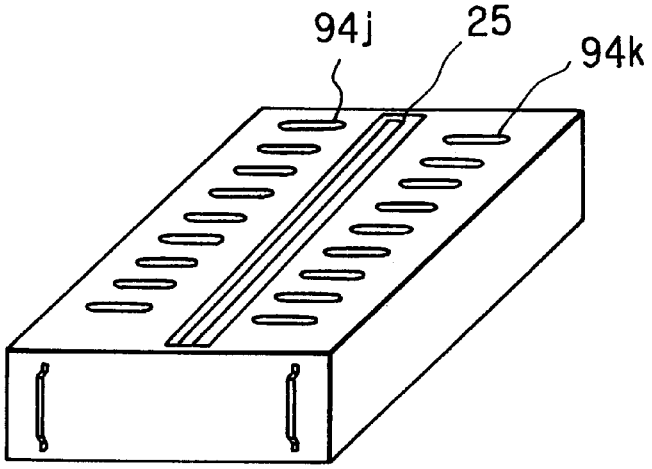
FIG. 9 is a perspective view showing a paper sucking portion having suction ports formed with aperture arrays made of circular openings.

Concerning suction ports 94*a* to 94*h*, as shown in a cross-section of FIG. 7, the portion which defines each suction port 94 of chamber 96 is beveled in order to prevent the front end of paper 5 from entering the opening. For suction ports 94*b* and 94*d* a slanted portion is formed on one side face of opposing electrode 25 as shown in FIG. 2. These beveled surfaces prevent the front end of paper 5 from entering suction port 94 and hence jamming. Each suction port 94 is provided flush with the flat plane 25*a* so as to keep paper 5 in contact with flat part 25*a* of opposing electrode 25, as shown in FIG. 2. It is also possible to form suction ports 94 at a lower level (at a more distant position from control electrode 26) than flat part 25*a* as shown in FIG. 4. Suction ports 94 are provided as slit-like openings as shown in FIG. 8. It is also possible to create aperture arrays made up of a plurality of circular openings 94*j* and 94*k* as shown in FIG. 9.

If suction ports 94 do not have a slit-like or aperture array configuration, they cannot always oppose the recording medium appropriately when various sizes of recording medium are used, possibly causing suction failure. In the above embodiment, since suction ports 94 are provided as slits, they can readily oppose the recording medium of an arbitrary size, thus avoiding one critical cause of suction failure.

Figure 10:
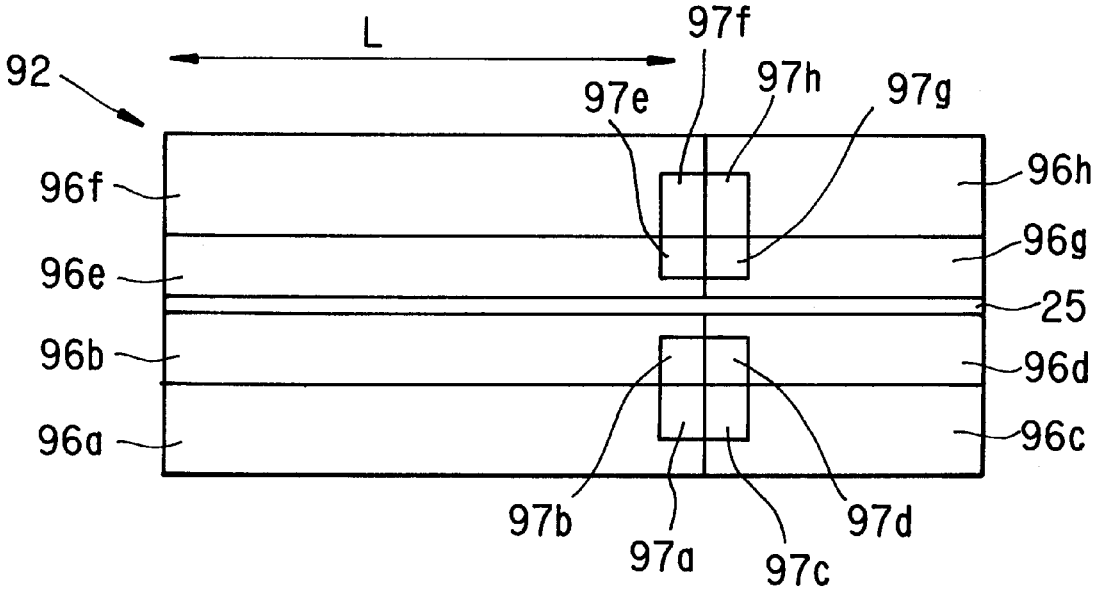
FIG. 10 is a transverse sectional view of the paper sucking portion shown in FIG. 8.
Figure 11:
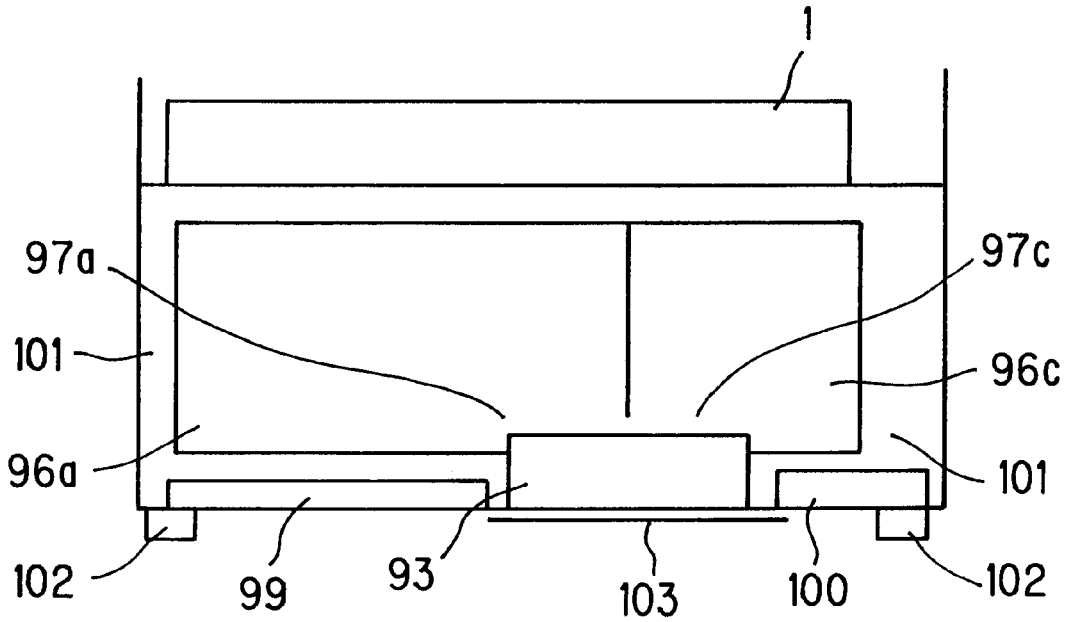
FIG. 11 is a vertical sectional view of an exhaust outlet portion of a paper sucking portion.

Chambers 96*a*–96*h* are arranged as shown in FIG. 8. FIG. 10 is a horizontal sectional view of FIG. 8. As seen in FIG. 10, a width L of chambers 96*a*, 96*b*, 96*e* and 96*f* is set equal to the width of postcards as the minimum paper size used in this image forming apparatus. Chambers 96*c*, 96*d*, 96*g* and 96*h* are arranged on the side of chambers 96*a*, 96*b*, 96*e* and 96*f*, producing a A4 size width as the maximum paper size used in this image forming apparatus. Openings 97*a*–97*d* and 97*e*–97*h* for each of the chambers are placed together in groups as shown in FIG. 10, and each group is positioned opposing corresponding fan 93*a* or 93*b* as decompressing means as shown in FIG. 11. FIG. 11 is a sectional view of suction portion 92 viewed from the front.

Figure 12:
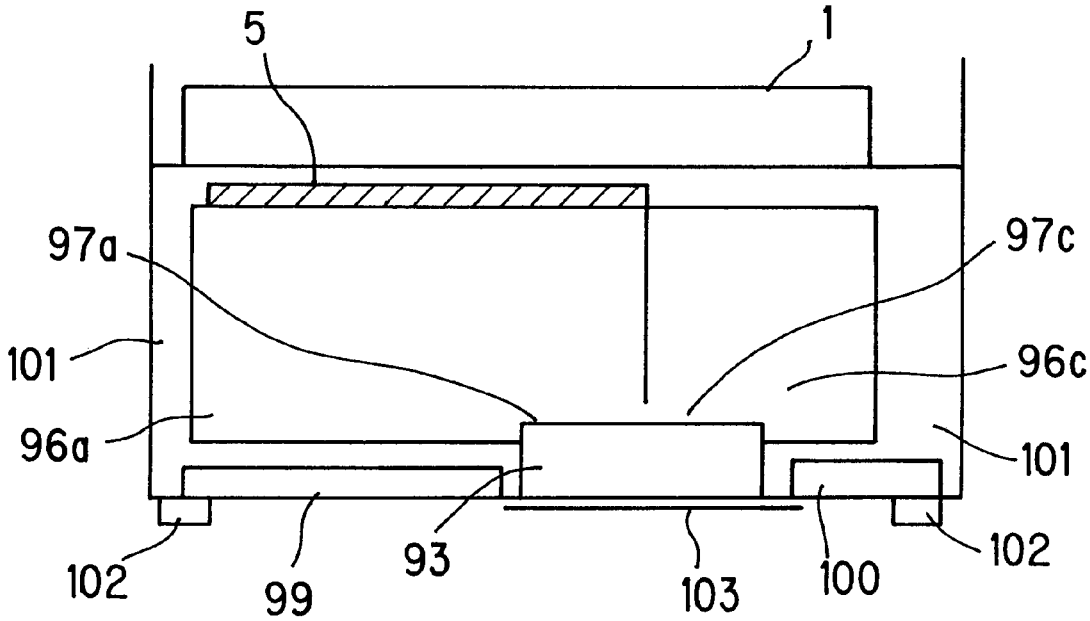
FIG. 12 is an illustrative view showing air discharging when the sheet is conveyed with no sheet present on some of the chambers.

In this way, suction ports 94 and chambers 96 are divided while openings 97 are arranged close to fans 93. This geometry enables a decompressed state formed by each chamber 96 and suction port 94 facing paper 5 to be maintained when various sizes of paper 5 are used, especially when small sized sheet of paper 5 are used and therefore some of suction parts 94 are left open. In this way, it is possible to achieve correct operation of suction without lowering the attractive force. In the case where the sucking means is made up of a single chamber, if a small sized sheet of paper 5 is fed, air flows in from suction ports 94 above which no paper 5 is placed. As a result, decompression cannot be produced through those suction ports 94 above which no paper 5 is placed. In this embodiment, such a case will not occur. As an example, even if no paper 5 is present around suction port 94*c* as shown in FIG. 12 so that no load acts on chamber 96*c*, air in the adjacent chamber 96*a* can be sucked with respect to opening 94*a* by fan 93*b* thus securing decompressing effects. In this way, it is possible to continue decompression in the chamber and hence achieve stable attraction of paper 5. Compared with the case where the sucking means is partitioned into chambers, each being equipped with an individual decompressing means, the embodiment of this invention needs fewer parts such as fans etc., and reduces the size and cost of the apparatus.

Next, the recording paper suction mechanism for sucking recording paper 5 will be detailed further. As shown in FIG. 2, this recording paper suction mechanism comprises a chamber 96, supports 94A–94D for supporting recording paper 5, and a pair of fans 93*a* and 93*b* for exhausting air from chamber 96. Here, chamber 96 accommodates opposing electrode 25. Supports 94A and 94B are arranged upstream of opposing electrode 25 with respect to the feeding direction of recording paper 5, while supports 94C and 94D are arranged downstream of opposing electrode 25.

Supports 94A–94D each have a support surface formed flush with flat part 25*a* of opposing electrode 25. A plurality of suction ports 94-1 to 94-4 are formed communicating with the support surface so that air inside chamber 96 can be discharged by fans 93*a* and 93*b*. This sucks air from the suction ports so as to attract paper 5 onto the support surface. These suction ports are surrounded by a flatly configured parts. Provided on the upstream side of suction port 94-1 is a guide 98 for guiding recording paper 5 over support 94A. In the apparatus shown in FIG. 2, a plurality of suction ports were arranged in the conveying direction of recording paper 5, but it is also possible to arrange them in the direction perpendicular to the conveying direction of recording paper 5.

As shown in sectional views in FIG. 2 and FIG. 14 below, each mouth of suction ports 94-1 to 94-4 formed in the supports is beveled so as to prevent the front end of recording paper 5 from entering the opening. This configuration prevents recording paper 5 from jamming due to the entrance of the front end of recording paper 5 into the suction ports.

The support surface of each support is formed flush with the flat part 25*a* of opposing electrode 25. Recording paper 5 is sucked onto the support surface so as to keep recording paper 5 in close contact with flat part 25*a* of opposing electrode. These support surfaces may be arranged at a more distant position from control electrode 26 than flat part 25*a* of opposing electrode 25.

Figure 13:
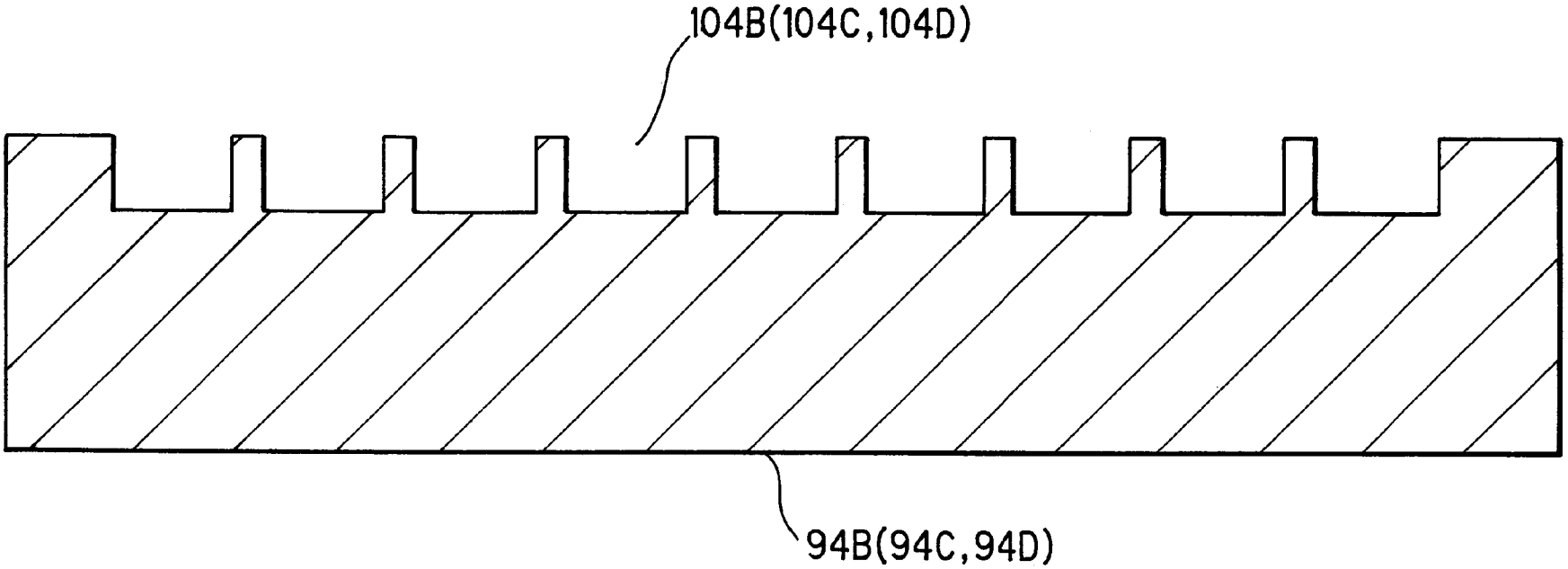
FIG. 13 is a sectional view showing a support in a recording paper sucking mechanism equipped in the image forming apparatus of the invention.
Figure 14:
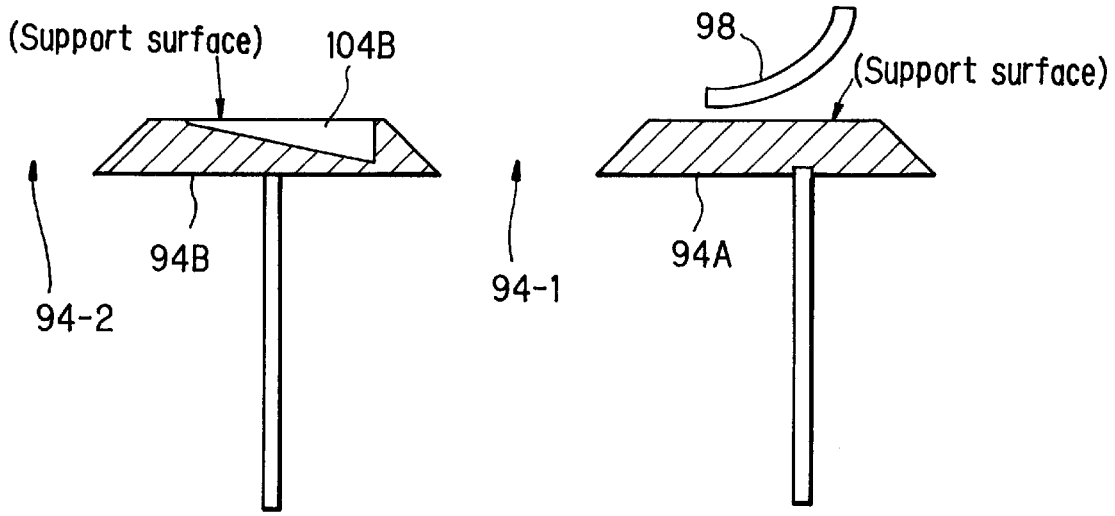
FIG. 14 is a sectional view showing a support in a recording paper sucking mechanism equipped in the image forming apparatus of the invention.
Figure 15:
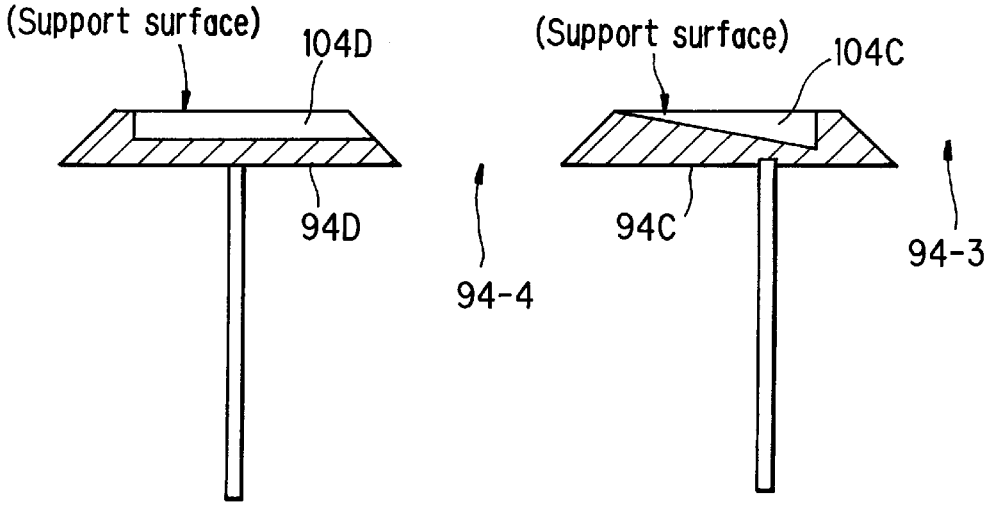
FIG. 15 is a sectional view showing a support in a recording paper sucking mechanism equipped in the image forming apparatus of the invention.

Next, supports 94A–94D each have grooves formed on their support surface as shown in FIGS. 13 to 15. Here, FIG. 13 is a sectional view of each support cut in a plane perpendicular to the conveying direction of recording paper. FIGS. 14 and 15 are sectional views in a plane in parallel to the conveying direction of recording paper. As seen in FIGS. 13 and 14, a set of grooves 104B(104C) which are formed in parallel with the conveying direction of recording paper are formed on the support surface of support 94B(94C) which is located on the downstream side of suction ports 94-1(94-3) while a set of grooves 104D which communicate with suction port 94-4 are formed on the support surface of support 94D which is located on the downstream side of suction port 94-4.

Grooves 104B–104D formed on respective supports 94B–94D which are located on downstream of resist roller 95 (paper conveying means) reduce the contact area between recording paper 5 and each of the supports, thus lowering the frictional resistance between recording paper 5 and the support surfaces. As a result, vibrations of recording paper 5 occurring during conveyance of recording medium due to this friction can be inhibited.

As shown in FIGS. 14 and 15, grooves 104B and 104C are formed shallower toward their downstream side with respect to the conveying direction of recording paper 5 (becoming shallower as they approach suction ports 94-2 and 94-4), and finally smoothly join the support surface which guides the paper to the suction port without any step. Therefore, if the front end of recording paper enters the grooves, no trouble (jamming) will occur during conveyance, thus it is possible to reliably convey recording paper 5. In the above example, although the grooves were specified as being shallower towards the downstream side with respect to the conveying direction of recording paper 5, it is also possible to provide a slanted surface in the end wall face of the groove on the downstream side of the conveying direction of recording paper 5.

As shown in FIG. 15, grooves 104D are made to communicate with suction port 94-4, forming an air flow passage from groove 104D to suction port 94-4. Accordingly, it is possible to exert suction force on recording paper 5 across the length of grooves 104D in addition to through suction port 94-4, establishing a broader range of suction to recording paper 5.

Grooves 104B, 104C and 104D are arranged on the downstream side of suction ports 94-1, 94-3 and 94-4, respectively, so it is possible to reliably attract recording paper 5 avoiding its vibration, thus enabling a good image forming operation. The grooves in each support can be formed by integral molding of ABS resin, which means reduction of parts and hence reduction in cost.

When recording paper 5 is distant from the support surface, the attracting force acting on the paper becomes smaller, resulting in failure of suction. In order to ensure the suction of recording paper 5, it is desirable that recording paper 5 should be made closer to suction port 94-1 when it is fed (conveyed). For this purpose, it is desirable to provide guiding member 98 for guiding recording paper to suction port 94-1. Further, the flat configuration surrounding suction port 94-1 will prevent air from leaking through suction port 94-1 and hence the suction force from being lowered when a recording paper 5 is being sucked.

Figure 16:
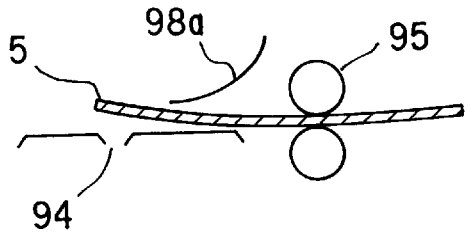
FIG. 16 is an illustrative view showing an inapt example of a guide.
Figure 17:
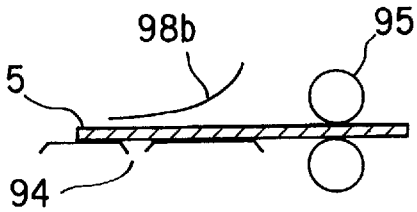
FIG. 17 is an illustrative view showing a guide of the invention.

It has been found that the sucking means using the above suction mechanism sharply lowers its suction force as the distance from suction port 94 to the paper becomes greater. In order to ensure the suction of paper 5, it is preferred that paper 5 is made closer to suction port 94 by inhibiting curl of paper 5. For this purpose, it is preferred that a guiding member for guiding paper 5 to suction port 94 be provided. However, the guide is of no use unless it definitely can guide paper 5 to the region where air flow is strong enough to suck paper 5. As an example, a guide 98*a* shown in FIG. 16 cannot guide paper 5 correctly enough to inhibit curl so that it is impossible to achieve the correct suction. Therefore, a guide as shown in FIG. 17 needs to be provided. More specifically, a guide 98 should be formed such that the gap allowing the sheet to pass therethrough is narrowed toward the downstream side with respect to the sheet conveying direction in order to press the curl of paper 5, with its front end (the end of guide 98*b*) extending to the region where the suction force is strong enough. In this arrangement, paper 5 is conveyed by guide 98*b* to the proximity of suction port 94. A guide of this type may be provided upstream of each suction port 94.

In the above embodiment, the distance between resist roller 95 and fixing means 11 is adapted to be smaller than the size of paper 5. Since the distance between resist roller 95 and fixing means 11 is shorter than the length of paper 5, there is no need to additionally provide conveying rollers as the conveying means and supporting members of paper 5. Therefore, it is possible to configure the simplest of conveying means.

Further, since there are no components which could come in contact with the toner image after the image forming before the fixing of the toner image, there is no possibility of image degradation and image destruction, and hence it is possible to fix a formed image in as good a condition as when it was formed. The above apparatus incorporates many heat emitting elements such as fixing unit 11, the high voltage driver or high voltage power source for controlling the potential to be applied to control electrode 26, and driver motors etc. Among these, heat emitted from fixing unit 11 is attributed to the main cause of raising the temperature inside the apparatus, giving rise a variety of problems. In conventional configurations, a separate cooling means for reducing the heat from these heat emitting elements has been provided to cool down the apparatus.

In the present embodiment, air in the space in front of control electrode 26 inside the apparatus is sucked from air suction ports 94 and discharged out of the apparatus. Since this air flow also draws the air around the electric circuits, driving system and fixing means, this hot air heated from the electric circuit, driving system and fixing means is discharged out of the apparatus. As a result, it is no longer necessary to separately provide a cooling means for cooling the apparatus, thus achieving reduction in number of parts and hence reduction in size and cost.

In the above embodiment, a pair of fans 93*a* and 93*b* are provided. If the same function is attempted to be made by only a single fan, a markedly higher power fan is needed, not only readily causing increase in cost and size of the apparatus but also generating large amount of noise. Thus, the single fan configuration is unpreferable. As in the above embodiment, an appropriate number of fans 93*a* and 93*b* are preferably used in combination. Here, the number of fans used should not be particularly limited to the above value.

Further, the air flow of paper suction portion 92 has another feature as follows. That is, fans 93 as the decompressing means continue to run, i.e., sucking air while opposing electrode 25 is being rotated during the interval between sheets. More specifically, even while cleaning brush 25*b* is in contact with control electrode 26 to clean it, chamber 96 is kept decompressed by drawing air from suction ports 94.

If air suction as in this embodiment is not effected during the cleaning operation, the following problems will occur. When cleaning brush 25*b* comes in direct contact with toner 21 adhering to control electrode 26 during the cleaning operation, the brush imparts physical force on the toner. Accordingly, not all the toner 21 thus swept will be retained by cleaning brush 25*b* but will be dispersed around control electrode 26 or scattered to flat part 25*a* or the conveyance path of paper 5 to stain the machine interior. Further, there is a risk that the toner adhering in the conveyance path might stain the rearside of paper 5.

In this embodiment, since air continues to be sucked from suction ports 94 during cleaning of the toner 21 adhering to the control electrode and hence the scattered toner 21 as stated above will be collected from suction ports 94 into the chamber, no problem will occur derived from scattered toner 21. Further, while the cleaning of control electrode 26 is performed by rotating opposing electrode 25 as shown in FIG. 7, the area of suction ports 94*e* becomes large, this also contributes to easy suction of scattered toner 21. The aforementioned toner scattering and toner dispersion are liable to occur when paper jamming has occurred, or when pre-rotation before the start of operation of the apparatus or post-rotation is effected. Therefore, suction is preferably implemented in these cases.

In the above embodiment, opposing electrode 25 and paper sucking means 92 are integrally formed as a unit. This image forming apparatus has the feature that it omits various processes compared to the image forming apparatus using electrophotographic process in which toner is also used. Accordingly, the apparatus of the invention can be markedly reduced in size. Therefore, the parts used are very small and need high positional precision. Further, attachment and removal of parts for maintenance such as replacement and cleaning of parts as well as when paper jamming has been corrected, need a high level of technique and knowledge. For this reason, it was very difficult for a typical user to implement these tasks for the parts concerned. However, since in this embodiment opposing electrode 25 and paper sucking means 92 are made into one unit as shown in FIG. 9, this configuration allows for a typical user to easily implement the above tasks.

In the present embodiment, fans 93*a* and 93*b* are arranged in the conveying direction of paper 5. The layout of this embodiment is effective in preserving free space with respect to the conveying direction of paper 5. In this embodiment, as shown in FIG. 11, a PCU board 99 and ICU board 100 are laid out on each side of fan 93*a* and 93*b*, and heat generated from both boards can be conducted to the suction ports through ducts 101.

Figure 18:
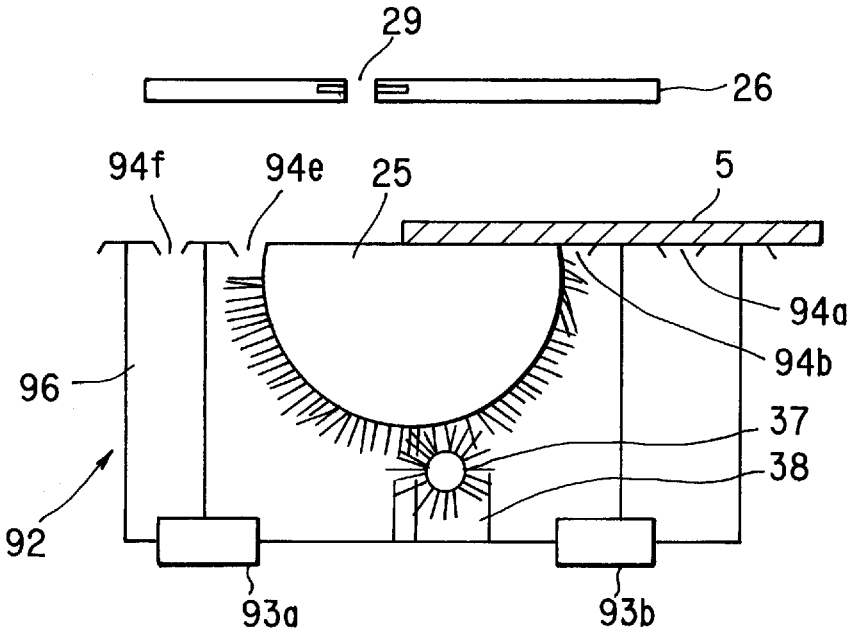
FIG. 18 is an illustrative view showing the sheet conveyance when a pair of fans are arranged upstream and downstream of the opposing electrode.

As in the present embodiment, in the case where fans 93*a* and 93*b* are arranged in parallel to the conveying direction of paper 5 and positioned upstream and downstream of opposing electrode 25, respectively, even if the suction port 94 on the downstream side of opposing electrode 25 is open and not receiving any load as shown in FIG. 18, it is possible to produce good suction performance without lowering the efficiency of sucking air from the upstream side. Conversely, if paper 5 exists only on the downstream side, it is possible to achieve good suction of paper 5 in the same way. In the above embodiment, the outlet ports of fans 93*a* and 93*b* are provided in the machine bottom so as to discharge the air from the apparatus. Accordingly, the user will never receive an air blast from fans 93*a* and 93*b* which would cause uncomfortable feeling.

Further, since the sound generated from fans 93*a* and 93*b* can be abated as stated above, this configuration contributes to the effect of lowering noise. The same effects can be obtained by arranging fans 93*a* and 93*b* in the rear of the apparatus so as to discharge air from the rearside. In the above embodiment, the toner is made to jump from the top to the bottom, but the apparatus can be configured such that the toner will jump from the bottom to the top. This configuration inevitably needs the suction-conveyance of paper 5 so that the present invention becomes more important.

Figure 19:
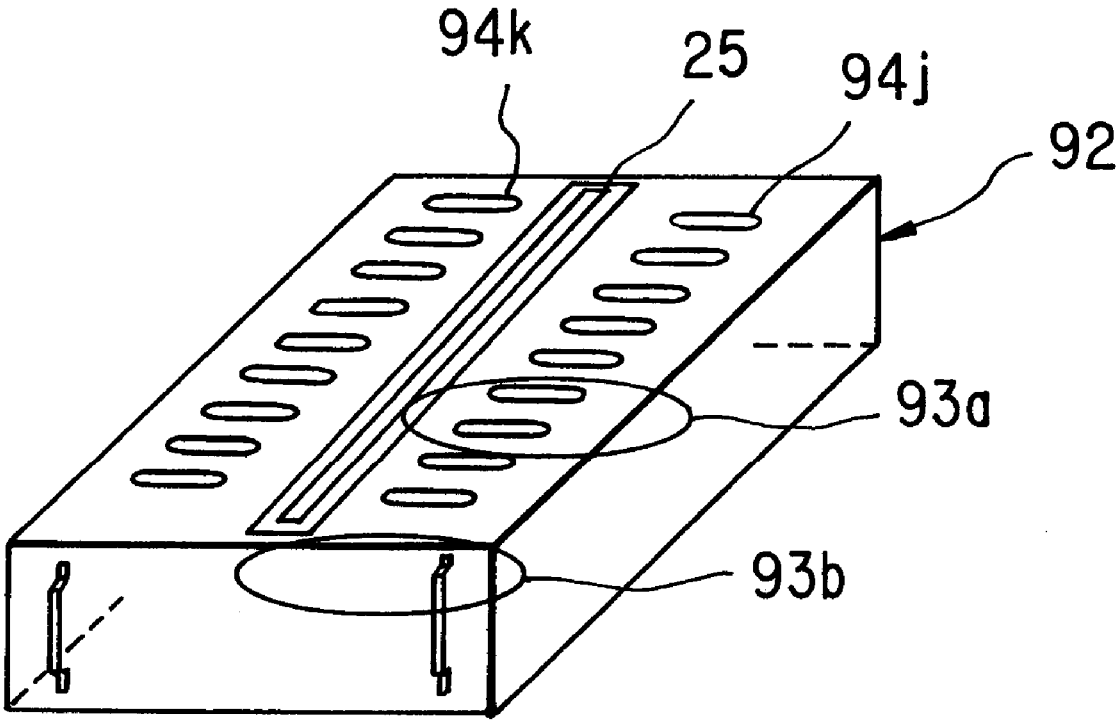
FIG. 19 is a perspective view showing a paper sucking portion in which fans are arranged lengthwise of the opposing electrode.

In the above embodiment fans 93*a* and 93*b* are arranged before and after opposing electrode 25, but if strong and still quiet fans are available, the fans can be arranged in parallel to the length of opposing electrode 25 as shown in FIG. 19. In this case, it is preferred that fans 93*a* and 93*b* are arranged on either side with opposing electrode 25 as their center. In this case, a variety of paper sizes can be suction conveyed satisfactorily without degrading suction performance, especially when the width of paper 5 arbitrarily diversifies.

Figure 20:
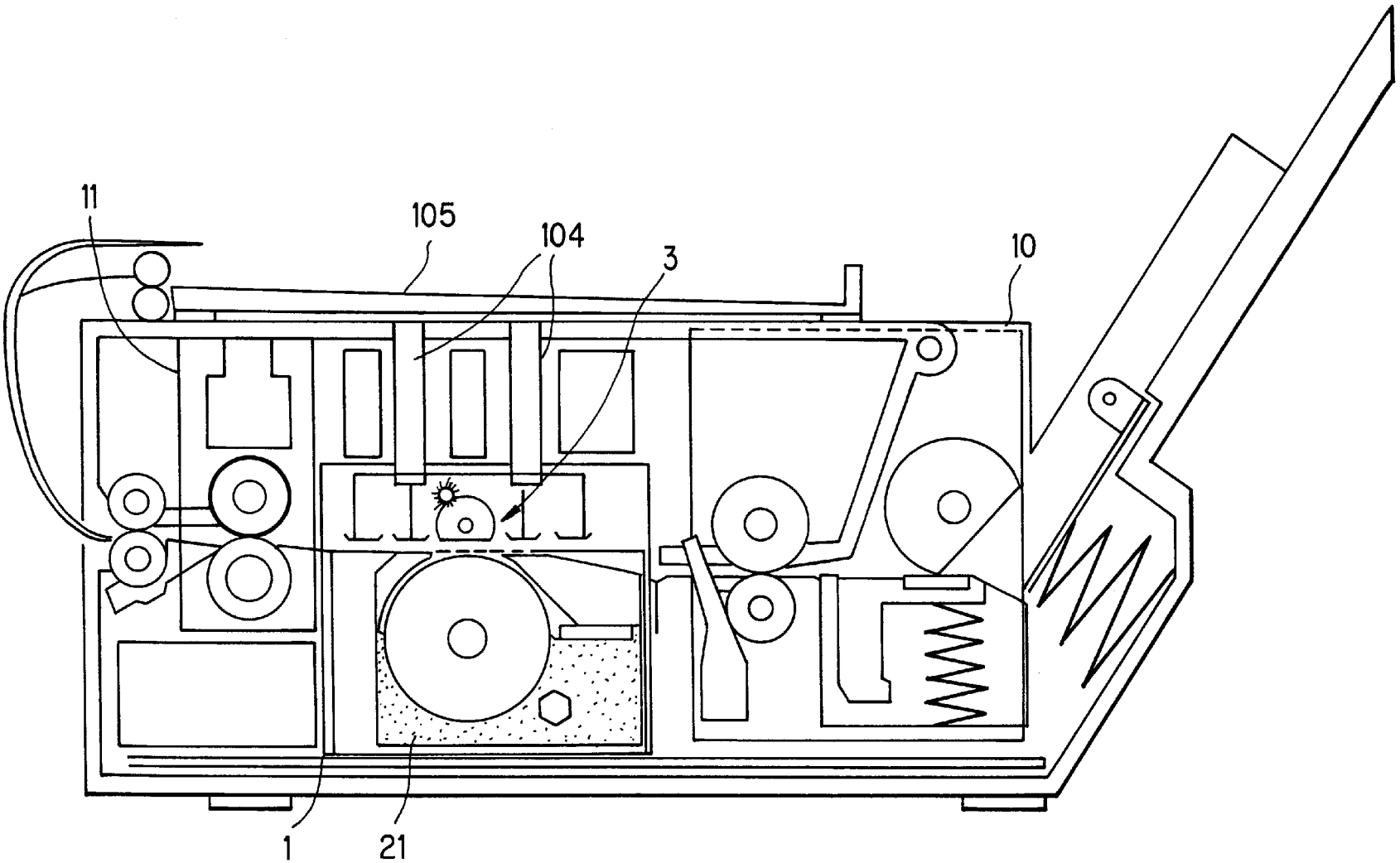
FIG. 20 is an overall configurational view showing a printer in which the toner support is disposed in the lower part so that the toner jumps from the bottom to the top.
Figure 21:
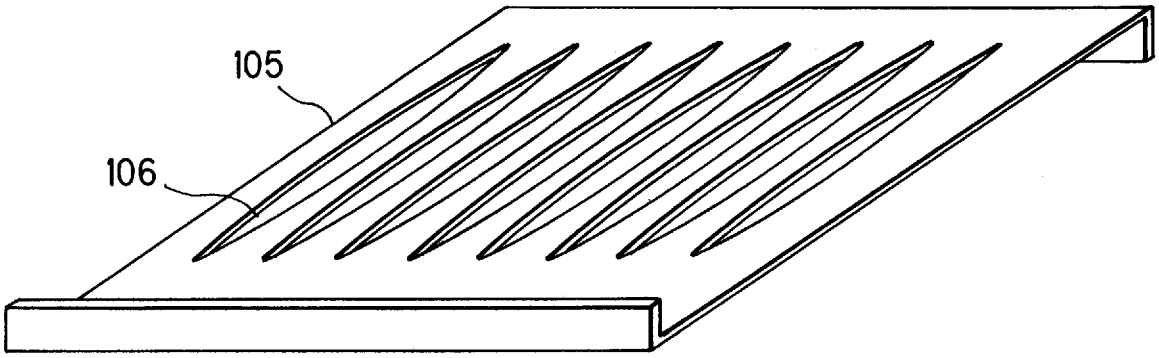
FIG. 21 is a perspective view of a paper output tray.

Further, in this embodiment, as shown in FIG. 11, an air guide 103 is arranged so that the air from fans 93*a* and 93*b* will not be exhausted directly. Since the air drawn by fans 93*a* and 93*b* may contain toner 21 as seen from the above, there is some structure present which will not allow toner 21 to stain the table etc. Further, supports 102 are provided on the underside of the machine so as to discharge the air more efficiently. It is also possible to configure such an arrangement where toner 21 is made to jump vertically from the bottom to the top and hence exhaust outlet passage 104 rests on the top face of the apparatus as shown in FIG. 20. In this case, the openings for discharging air are formed on the paper output tray 105 side. Paper output tray 105 has a projected portion on its distal end and has a configuration that will not block the openings as shown in FIG. 21. This paper output tray also serves as the air guide. It is also possible to provide slits 106 so as to smoothly discharge air from the openings. This configuration enables a two purpose use as the paper output tray and the air guide, needing fewer parts and hence reducing the apparatus in size and cost.

Figure 22:
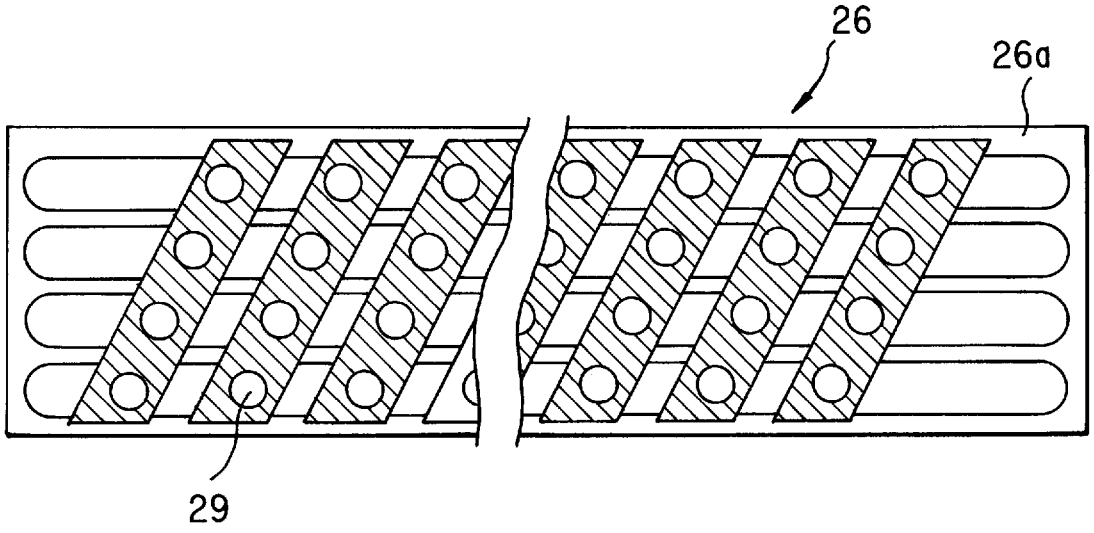
FIG. 22 is a configurational view showing another example of a control electrode.

In the above embodiment, although an image forming apparatus using toner as the developer was exemplified, the developer may be of ink. Further, although a configuration having control electrode 26 with annular electrodes 27 was exemplified, control electrode 26 should not be particularly limited to the above configuration. For example, instead of using control electrode 26 having annular electrodes 27, it is also possible to control toner 21 transfer from toner support 22 to opposing electrode 25 by providing a plurality of strip-like electrodes matrix-wise on both sides of board 26*a* of control electrode 26 (see FIG. 22), forming passage holes to be gates 29 at the cross over points of each at right angles or at another angle, and governing the voltage to be applied to the strip-like electrodes. In this case, the number of the high voltage drivers needed can be markedly reduced. Further, since the distance of control electrode 26 in the conveying direction of paper 5 becomes longer, the sucking means of the above embodiment for attracting paper to control electrode 26 is more beneficial.

In accordance with the embodiment described above, a monochrome image forming apparatus was illustrated. The present invention is also effective in being applied to color image forming apparatuses. As an example, a color image forming apparatus with a plurality of image forming units made up of toner supplying sections and printing sections is configured where the toner supplying sections are filled with different colors of toner.

In general, in the case of the color image forming apparatus, it is necessary to precisely place plural kinds of developers. Therefore, if the recording paper deviates from its correct position, it is impossible to obtain dots having the desirable dot diameter and density, resulting in failure to obtain correct color reproduction.

Figure 23:
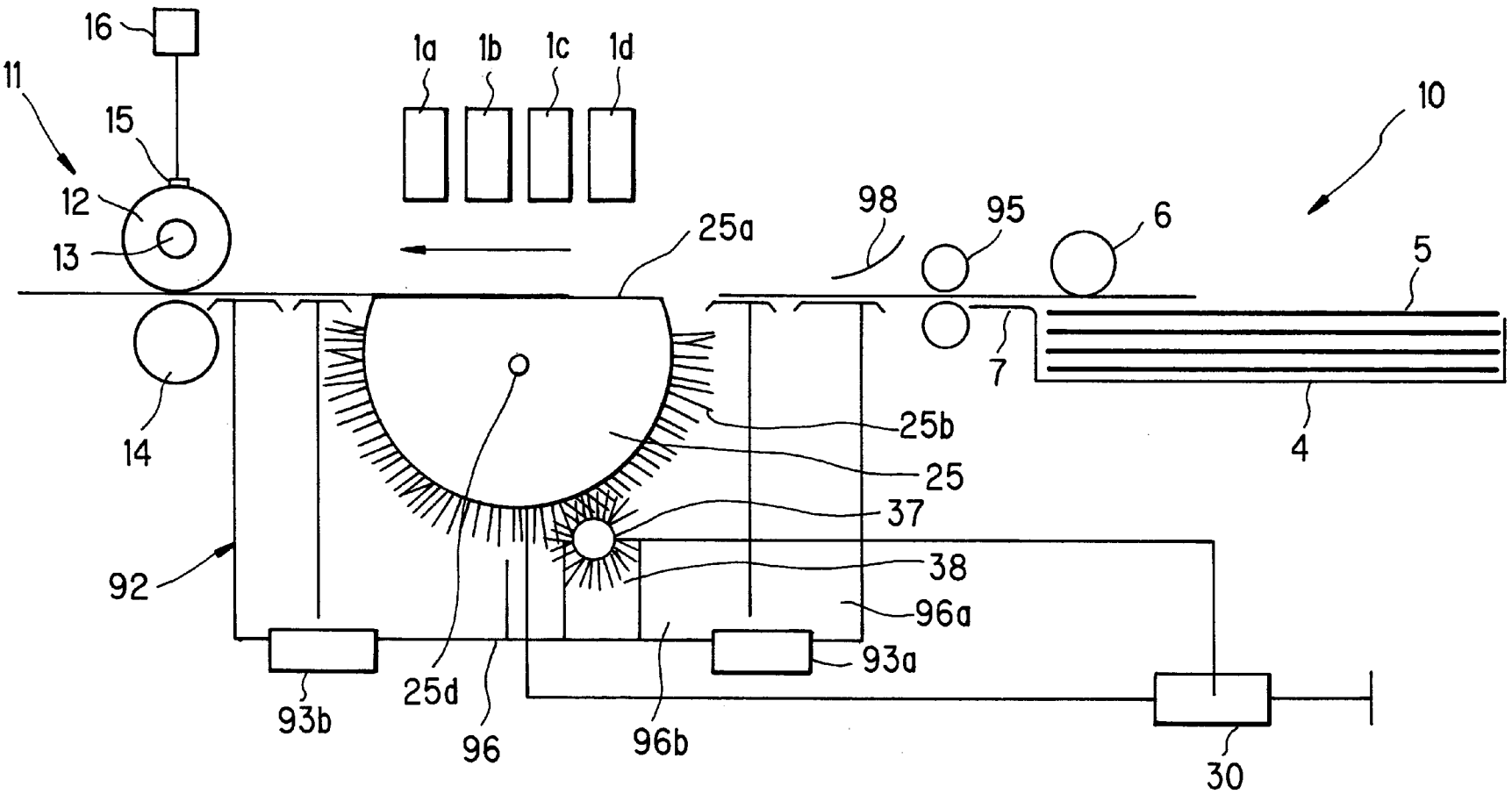
FIG. 23 is a schematic configurational view showing a color image forming apparatus.

Concerning this aspect, in accordance with the apparatus of this embodiment, since the recording paper can be conveyed in a stable manner by inhibiting its vibration whilst keeping it in a constant positional relation to the control electrode, it is possible to place the developers onto the recording paper surface with high precision. Accordingly, it is possible to obtain the desired color reproduction, and hence form excellent color images. In FIG. 23, image forming units 1*a*, 1*b*, 1*c* and 1*d* corresponding to yellow, magenta, cyan and black are arranged so as to create color images in accordance with respective colors of image data. The other components may be the same as those in FIG. 2.

Figure 24:
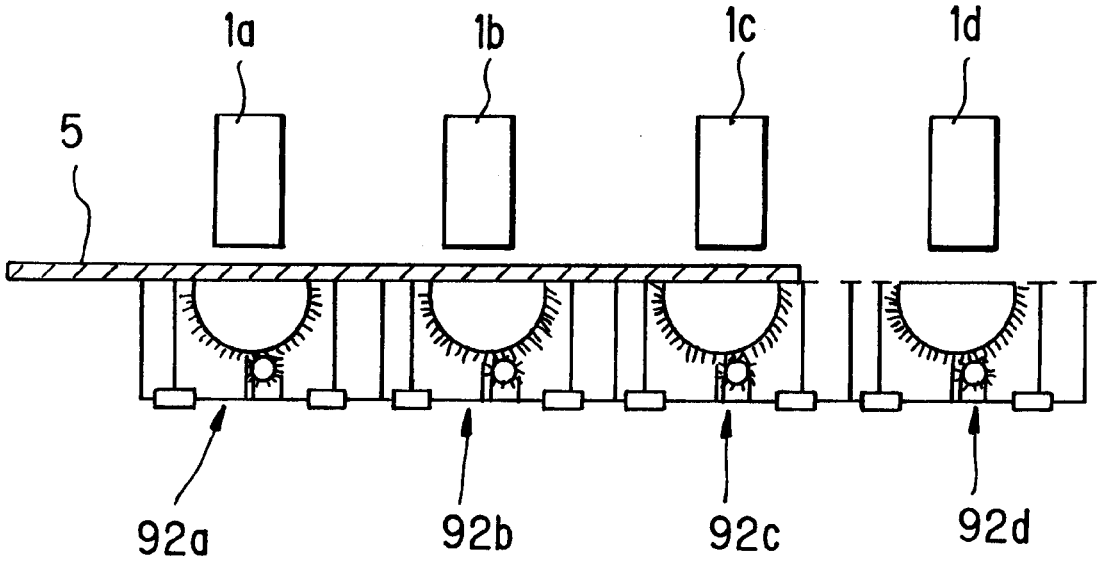
FIG. 24 is a schematic diagram showing essential parts of another color image forming apparatus.

Further, paper sucking means 92*a*–92*d* may be provided for each toner supplying section as shown in FIG. 24. In the case of a color image forming apparatus, since desired toner transfer could not be performed if the aforementioned problems occurred, it would be impossible to obtain dots having the desired diameter and density and hence a further problem would occur in that correct color reproduction could not be obtained. In accordance with the invention, the above problems will not occur at all, and excellent color image forming with the desired color reproduction can be attained.

In the case of the color image forming apparatuses using a plurality of developing vessels as shown in FIGS. 23 and 24, there are cases where the operation of development is made whilst cleaning is being performed. For example, consider a case where development is effected using one of the color developing vessels whilst no recording medium exists on the opposing electrode surfaces facing the other colors of developing vessels (for example, 92*d* in FIG. 24). In this case, the control electrode facing the opposing electrode being unused is assumed to be cleaned. During this, the color toner which is being cleaned could be scattered in the space around the control electrode by the cleaning operation, for example, brushing. In this case, the toner scattered during cleaning might transfer to the recording medium residing on the opposing electrode surface engaged in the printing, causing partial color fogginess as well as inducing color mixing. Consider a case of this invention where development is effected using one of the color developing vessels whilst no recording medium exists on the opposing electrode surfaces facing the other colors of developing vessels (for example 92*d* in FIG. 24) and the control electrode facing the opposing electrode being unused is assumed to be cleaned. In this case, even though the color toner which is being cleaned is scattered around the space near the control electrode by the cleaning operation, i.e., brushing, air is continuously sucked through the suction port of paper suction portion 94*d* being engaged in the cleaning operation, and in addition, the open area of the suction ports 94 becomes large during cleaning as shown in FIG. 7. As a result, scattered toner is quickly sucked from suction ports 94 without transferring to other control electrode 25, thus making it possible to avoid partial blur and color mixing.

It is also possible to construct toner supplying section 2 with a structure using an ion flow process. Specifically, the image forming unit may include an ion source such a corona charger or the like. Also in this case, it is possible to attain the same effect as stated above.

The image forming apparatus in accordance with this embodiment can be widely applied to digital copiers, facsimile machines as well as to digital printers, plotters, etc. Further, in the description of the embodiment, an example where toner is used as the developer was explained, but ink or other material can be used as the developer. Moreover, a plurality of resist rollers 95 as the paper conveying means may be provided along the conveyance path of recording paper 5.

As has been apparent from the above description, the present invention has the following effects.

First, in the image forming apparatus of the first feature of the invention, by providing a conveying means independent of the opposing electrode, it is possible to convey the recording medium keeping it at a predetermined position even when the sucking strength is regulated so that the airflow drawn from the suction port in the sucking means over which no recording medium is present is adjusted so as not to stir the developer on the supporting means and the control electrode. As a result, it is possible to convey the recording medium keeping a constant distance from the control electrode, thus making it possible to prevent the occurrence of image failure due to frictional contact of the recording medium against the control electrode. Further, since the opposing electrode having a flat surface which is ideal for image forming is used, an excellent image can be formed.

In the image forming apparatus of the second feature of the invention, even when the front end of the recording medium almost enters the suction port during the conveyance of the recording medium, the beveled surface abuts the front end of the recording medium so as to revert it back along the slanted surface to its due conveyance path. Accordingly, it is possible to prevent conveyance failure and paper jamming by a very simple method.

In the image forming apparatus of the third and fourth features of the invention, the opposing electrode is accommodated inside the chamber and also defines part of the suction port. Therefore, the recording medium can be sucked in the closest position to the opposing electrode, thus making it possible to attain excellent conveyance of the recording medium.

In the image forming apparatus of the fifth feature of the invention, since the guiding member is disposed so as to guide the recording medium to the region where the air flow is strong enough to suck the recording medium, it is possible to achieve excellent suction conveyance without causing any suction failure.

In the image forming apparatus of the sixth feature of the invention, since a plurality of chambers share one decompressing means, it is possible to effect decompression using less number of decompressing means. Accordingly, it is possible to reduce the number of parts and hence the apparatus in size and cost. Further, even when one of the plural chambers opposite to the decompressing means is left open, it is possible to maintain the decompressed state in the other chambers to thereby continue excellent sucking.

In the image forming apparatus of the seventh feature of the invention, since a pair of sets of the decompressing means and the chambers are disposed upstream and downstream of the opposing electrode, it is possible to attain excellent suction-conveyance without lowering the sucking force even when the recording medium is present over only one of the suction ports located upstream and downstream of the opposing electrode.

In the image forming apparatus of the eighth feature of the invention, since the decompressing means are arranged perpendicularly to the conveying direction of the recording medium, it is possible to maintain excellent suction even when a narrow-width recording medium is used and hence part of the suction port is left open.

In the image forming apparatus of the ninth feature of the invention, since the boundaries of the chambers are positioned depending upon the sizes of recording medium, it is possible to make each chamber correctly oppose the recording medium and hence inhibit sucking loss at the minimum level.

In the image forming apparatus of the tenth through fourteenth features of the invention, since the sucking means which is not engaged in image forming is operated so that its airflow drawn to the sucking port is utilized to easily collect the developer particles scattered around the control electrode and the opposing electrode. Further, by continuously operating the decompressing means, hot air can be drawn from the suction port, thus making it possible to cool down the apparatus without providing a separate cooling means. Therefore, it is possible to reduce the number of parts and hence reduce the apparatus in size and cost.

In the image forming apparatus of the fifteenth through nineteenth features of the invention, by enlarging the open area of the suction port, the air can be very smoothly sucked from the suction port, so that it is possible to improve the efficiency of collection of the developer particles dispersed inside the apparatus into the suction port.

In the image forming apparatus of the twentieth through twenty-fourth features of the invention, since the outlet port for discharging air from the apparatus interior and the output tray of the recording medium are disposed on the same plane, it is possible to make the apparatus compact and make the output tray serve as the blocking member for preventing the developer from being discharged from the outlet port. Therefore, it is possible to reduce the number of parts and hence reduce the apparatus in size and cost.

In the image forming apparatus of the twenty-fifth feature of the invention, since the opposing electrode and the sucking means are formed as a single unit, the handling can be simplified when paper is jamming or the maintenance of the apparatus needs be performed by replacing the unit, so that a typical user can easily implement the maintenance of the apparatus.

In the image forming apparatus of the twenty-sixth feature of the invention, since the decompressing means can suck air even from the space in the set of the supporting means and opposing electrode which are not engaged in printing, it is possible to collect dispersed developer particles so as to avoid color mixing and blur due to the scattered developer particles. Further, by continuously operating the decompressing means, hot air can be sucked from the suction port, thus making it possible to cool the apparatus without providing a separate cooling means. Therefore, it is possible to reduce the number of parts and hence reduce the apparatus in size and cost.

In the image forming apparatus of the twenty-seventh and twenty-eighth features of the invention, since grooves are formed on the conveyance path (support surface) of the recording paper, it is possible to reduce or eliminate vibration of the recording medium which would occur when the recording medium is conveyed whilst being sucked (pressed) onto the opposing electrode. Therefore it is possible to achieve high quality of images excellent in reproduction performance of halftones and colors.

In the image forming apparatus of the twenty-ninth and thirtieth features of the invention, since the grooves are formed on the downstream side of the suction port, it is possible to prevent the front end of the recording medium from vibrating.

In the image forming apparatus of the thirty-first through thirty-fourth features of the invention, since the grooves formed on the support surface are made to communicate with the suction port, it is possible to ensure airflow by the grooves, thus establishing a broader range of suction to the recording paper and hence achieving a further stabilized support of the recording medium.

In the image forming apparatus of the thirty-fifth through forty-second features of the invention, the recording paper can be smoothly guided to the suction port even if the front end of the recording paper enters the grooves, thus making it possible to prevent the recording paper from jamming.

Accordingly, in accordance with the present invention, an air sucking method is used so that it becomes possible to attract the paper by a simple method. Further, since the area surrounding the suction port is configured by flat surfaces, it is possible to perform a more efficient decompression for sucking the paper. Further, since grooves are formed in the conveyance path of the recording paper, it is possible to reduce the number of parts without needing a separate conveyance path and hence reduce the apparatus in size and cost.

What is claimed is:

1. An image forming apparatus comprising:

a supporting means for supporting developer;

an opposing electrode disposed facing the supporting means;

a control electrode disposed between the supporting means and the opposing electrode and having a plurality of electrodes, each electrode surrounding a gate which forms a passage for the developer;

a conveying means for conveying a recording medium on which an image is recorded, into a space between the control electrode and the opposing electrode;

a controlling means which generates a predetermined potential difference between the supporting means and the opposing electrode and, by varying the potential applied to the control electrode, controls passage of the developer through each gate to form an image on the recording medium being conveyed between the control electrode and the opposing electrode;

wherein the conveying means includes:

an input conveying means disposed on an upstream side of the opposing region between the opposing electrode and the control electrode with respect to the conveying direction of the recording medium, for feeding the recording medium into the space between the control electrode and the opposing electrode, and an output conveying means disposed on a downstream side of the opposing region between the opposing electrode and the control electrode with respect to the conveying direction of the recording medium, for discharging the recording medium from the space between the control electrode and the opposing electrode, wherein the input conveying means and the output conveying means are arranged so that a distance between the two is shorter than a length of the recording medium with respect to the conveying direction; and a sucking means, disposed between the input conveying means and the output conveying means, for suction holding the recording medium at a predetermined position between the control electrode and the opposing electrode, the sucking means including:

a chamber having a suction port that is provided near and in fixed relation to the opposing electrode and an outlet port, and a decompressing means disposed in proximity to the outlet port for reducing pressure inside the chamber so that air inside the chamber is exhausted from the outlet port by means of the decompressing means to reduce the pressure in the chamber to thereby suck the recording medium to the suction port.

2. The image forming apparatus according to claim 1, wherein at least edges forming the suction port and being located across the conveying direction of the recording medium are beveled so that the suction port becomes narrowed in the air sucking direction.

3. The image forming apparatus according to claim 2, wherein the sucking means has an opening formed in the chamber, accommodates at least part of the opposing electrode in the opening and uses the opening portion other than the accommodating portion as the suction port.

4. The image forming apparatus according to claim 1, wherein the sucking means has an opening formed in the chamber, accommodates at least part of the opposing electrode in the opening and uses the opening portion other than the accommodating portion as the suction port.

5. The image forming apparatus according to claim 1, comprising a guiding member which is formed such that a gap between the chamber and the guiding member becomes narrowed as the guiding member approaches toward a downstream side thereof with respect to the conveying direction of recording medium, and which has an end on the downstream side thereof extending to the region where the force of sucking the recording medium to the suction port is strong enough.

6. The image forming apparatus according to claim 1, wherein the sucking means has a plurality of chambers and the outlet ports of neighboring chambers are formed adjacent to each other so that one decompressing means is provided in proximity with the grouped outlet ports so as to reduce the pressure in each of the plurality of chambers.

7. The image forming apparatus according to claim 6, wherein the decompressing means for reducing pressure in the chamber can be operated other than during conveying the recording medium so that air sucked from the suction port is discharged out of the apparatus.

8. The image forming apparatus according to claim 7, wherein the open area of the suction port can be changed in size.

9. The image forming apparatus according to claim 7, further comprising an exhaust outlet passage for discharging air from the chamber by means of the decompressing means to an exterior of the apparatus and an output tray which receives the recording medium with images formed thereon and is provided so as to cover the exhaust outlet passage but not to block the outlet opening thereof.

10. The image forming apparatus according to claim 1, wherein the sucking means has a plurality of chambers, grouped in two parts each having one decompressing means, and the groups are arranged upstream and downstream of the opposing electrode with respect to the conveying direction of the recording medium.

11. The image forming apparatus according to claim 10, wherein the decompressing means for reducing pressure in the chamber can be operated other than during conveying the recording medium so that air sucked from the suction port is discharged out of the apparatus.

12. The image forming apparatus according to claim 11, wherein the open area of the suction port can be changed in size.

13. The image forming apparatus according to claim 11, further comprising an exhaust outlet passage for discharging air from the chamber by means of the decompressing means to an exterior of the apparatus and an output tray which receives the recording medium with images formed thereon and is provided so as to cover the exhaust outlet passage but not to block the outlet opening thereof.

14. The image forming apparatus according to claim 1, wherein the sucking means has a plurality of chambers, the chambers and the decompressing means are arranged perpendicularly to the conveying direction of the recording medium.

15. The image forming apparatus according to claim 14, wherein the decompressing means for reducing pressure in the chamber can be operated other than during conveying the recording medium so that air sucked from the suction port is discharged out of the apparatus.

16. The image forming apparatus according to claim 15, wherein the open area of the suction port can be changed in size.

17. The image forming apparatus according to claim 15, further comprising an exhaust outlet passage for discharging air from the chamber by means of the decompressing means to an exterior of the apparatus and an output tray which receives the recording medium with images formed thereon and is provided so as to cover the exhaust outlet passage but not to block the outlet opening thereof.

18. The image forming apparatus according to claim 1, wherein the sucking means has a plurality of chambers and decompressing means, where boundaries of the chambers reside within a width of the recording medium to be conveyed and are positioned in the proximity to side edges of the recording medium.

19. The image forming apparatus according to claim 18, wherein the decompressing means for reducing pressure in the chamber can be operated other than during conveying the recording medium so that air sucked from the suction port is discharged out of the apparatus.

20. The image forming apparatus according to claim 19, wherein the open area of the suction port can be changed in size.

21. The image forming apparatus according to claim 19, further comprising an exhaust outlet passage for discharging air from the chamber by means of the decompressing means to an exterior of the apparatus and an output tray which receives the recording medium with images formed thereon and is provided so as to cover the exhaust outlet passage but not to block the outlet opening thereof.

22. The image forming apparatus according to claim 1, wherein the decompressing means for reducing pressure in the chamber can be operated other than during conveying the recording medium so that air sucked from the suction port is discharged out of the apparatus.

23. The image forming apparatus according to claim 22, wherein the open area of the suction port can be changed in size.

24. The image forming apparatus according to claim 22, further comprising an exhaust outlet passage for discharging air from the chamber by means of the decompressing means to the exterior of the apparatus and an output tray which receives the recording medium with images formed thereon and is provided so as to cover the exhaust outlet passage but not to block the outlet opening thereof.

25. The image forming apparatus according to claim 1, wherein the opposing electrode and a least part of the sucking means are integrally formed as a single unit which is detachable.

26. The image forming apparatus according to claim 1, wherein plural colors of developers are used and a set of the supporting means and opposing electrode is provided for each color, and the decompressing means is adapted for air-suction even from the space between the supporting means and opposing electrode which are not engaged in printing.

27. An image forming apparatus comprising:

a supporting means for supporting developer;

an opposing electrode disposed facing the supporting means for creating an electric field in cooperation with the supporting means;

a recording medium conveying means for feeding a recording medium (recording paper) to the major surface of the opposing electrode;

a control electrode disposed in the transfer routes of the developer jumping from the supporting means toward the opposing electrode, wherein the potential of the control electrode is controlled in accordance with an image signal to form an image on the recording medium;

a support, in fixed relation to the opposing electrode, that supports a support surface which is arranged approximately flush with the major surface of the opposing electrode so as to support the recording medium and define an opening of a suction port;

a sucking means for sucking air through the suction port so as to attract the recording medium to the support surface; and wherein a plurality of grooves are arranged in parallel to the conveying direction of the recording medium and are formed in each support surface, on a downstream side of the recording medium conveying means with respect to the conveying direction of the recording medium.

28. The image forming apparatus according to claim 27, wherein a plurality of suction ports are arranged in one of the conveying direction of the recording medium (recording paper) or perpendicularly to the conveying direction thereof.

29. The image forming apparatus according to claim 28, wherein the grooves are formed on a downstream side of the suction port with respect to the conveying direction of the recording paper.

30. The image forming apparatus according to claim 29, wherein the suction port is formed so as to communicate with the grooves.

31. The image forming apparatus according to claim 30, wherein a slanted surface is provided in the groove end face located on the downstream side of the plurality of grooves with respect to the conveying direction of the recording paper.

32. The image forming apparatus according to claim 29, wherein a slanted surface is provided in the groove end face located on the downstream side of the plurality of grooves with respect to the conveying direction of the recording paper.

33. The image forming apparatus according to claim 28, wherein the suction port is formed so as to communicate with the grooves.

34. The image forming apparatus according to claim 33, wherein a slanted surface is provided in the groove end face located on the downstream side of the plurality of grooves with respect to the conveying direction of the recording paper.

35. The image forming apparatus according to claim 28, wherein a slanted surface is provided in the groove end face located on the downstream side of the plurality of grooves with respect to the conveying direction of the recording paper.

36. The image forming apparatus according to claim 27, wherein the grooves are formed on a downstream side of the suction port with respect to the conveying direction of the recording paper.

37. The image forming apparatus according to claim 36, wherein the suction port is formed so as to communicate with the grooves.

38. The image forming apparatus according to claim 37, wherein a slanted surface is provided in the groove end face located on the downstream side of the plurality of grooves with respect to the conveying direction of the recording paper.

39. The image forming apparatus according to claim 36, wherein a slanted surface is provided in the groove end face located on the downstream side of the plurality of grooves with respect to the conveying direction of the recording paper.

40. The image forming apparatus according to claim 27, wherein the suction port is formed so as to communicate with the grooves.

41. The image forming apparatus according to claim 40, wherein a slanted surface is provided in the groove end face located on the downstream side of the plurality of grooves with respect to the conveying direction of the recording paper.

42. The image forming apparatus according to claim 27, wherein a slanted surface is provided in the groove end face located on the downstream side of the plurality of grooves with respect to the conveying direction of the recording paper.

43. An image forming apparatus comprising:

a supporting means for supporting developer; an opposing electrode disposed facing the supporting means;

a control electrode disposed between the supporting means and the opposing electrode and having a plurality of electrodes, each electrode surrounding a gate which forms a passage for the developer;

a conveying means for conveying a recording medium on which an image is recorded, into a space between the control electrode and the opposing electrode;

a controlling means which generates a predetermined potential difference between the supporting means and the opposing electrode and, by varying the potential applied to the control electrode, controls passage of the developer through each gate to form an image on the recording medium being conveyed between the control electrode and the opposing electrode;

wherein the conveying means includes:

an input conveying means disposed on an upstream side of the opposing region between the opposing electrode and the control electrode with respect to the conveying direction of the recording medium, for feeding the recording medium into the space between the control electrode and the opposing electrode, and an output conveying means disposed on a downstream side of the opposing region between the opposing electrode and the control electrode with respect to the conveying direction of the recording medium, for discharging the recording medium from the space between the control electrode and the opposing electrode, wherein the input conveying means and the output conveying means are arranged so that a distance between the two is shorter than a length of the recording medium with respect to the conveying direction; and a sucking means, disposed between the input conveying means and the output conveying means, for suction holding the recording medium at a predetermined position between the control electrode and the opposing electrode, the sucking means including:

a chamber having a suction port which is provided near the opposing electrode and an outlet port, and a decompressing means disposed in proximity to the outlet port for reducing pressure inside the chamber so that air inside the chamber is exhausted from the outlet port by means of the decompressing means to reduce the pressure in the chamber to thereby suck the recording medium to the suction port, and wherein the suction port is configured so as to form a slit-like opening perpendicular to the conveying direction of the recording medium, the suction port including slanted surfaces being slanted toward a sucking direction so as to narrow the opening of the suction port.

44. An image forming apparatus comprising:

a supporting means for supporting developer;

an opposing electrode disposed facing the supporting means for creating an electric field in cooperation with the supporting means;

a recording medium conveying means for feeding a recording medium to the major surface of the opposing electrode;

a control electrode disposed in the transfer routes of the developer jumping from the supporting means toward the opposing electrode, wherein the potential of the control electrode is controlled in accordance with an image signal to form an image on the recording medium;

a support for supporting a support surface which is arranged approximately flush with the major surface of the opposing electrode so as to support the recording medium and define an opening of a suction port;

a sucking means for sucking air through the suction port so as to attract the recording medium to the support surface;

wherein a plurality of grooves are arranged in parallel to the conveying direction of the recording medium and are formed in each support surface, on a downstream side of the recording medium conveying means with respect to the conveying direction of the recording medium; and wherein the suction port is configured so as to form a slit-like opening perpendicular to the conveying direction of the recording medium, the suction port including slanted surfaces being slanted toward a sucking direction so as to narrow the opening of the suction port.

* * * * *